US008783506B2

(12) United States Patent
Lee

(10) Patent No.: US 8,783,506 B2
(45) Date of Patent: Jul. 22, 2014

(54) CONTAINER FOR FOOD AND BEVERAGE

(76) Inventor: Jung Min Lee, Seoul (KR)

( * ) Notice: Subject to any disclaimer, the term of this patent is extended or adjusted under 35 U.S.C. 154(b) by 1863 days.

(21) Appl. No.: 10/536,578

(22) PCT Filed: Dec. 1, 2003

(86) PCT No.: PCT/KR03/02618

§ 371 (c)(1),
(2), (4) Date: Aug. 11, 2006

(87) PCT Pub. No.: WO2004/050499

PCT Pub. Date: Jun. 17, 2004

(65) Prior Publication Data

US 2011/0094904 A1 Apr. 28, 2011

(30) Foreign Application Priority Data

Nov. 30, 2002 (KR) ..... 10-2002-0076434
Dec. 10, 2002 (KR) ..... 10-2002-0080084

(51) Int. Cl.
*A47G 19/22* (2006.01)

(52) U.S. Cl.
USPC ..... 220/705; 206/217; 426/119

(58) Field of Classification Search
USPC ..... 220/705, 708, 212, 23.83, 23.86, 505, 220/521, 523, 710; 206/217, 223; 426/119, 426/120; 229/120.32; 215/6
See application file for complete search history.

(56) References Cited

U.S. PATENT DOCUMENTS 2,308,241 A * 1/1943 Hogaboom, Jr. ..... 426/80
2,740,575 A * 4/1956 Fontaine ..... 229/103.1
3,288,344 A * 11/1966 Woollen et al. ..... 229/103.1
4,189,072 A * 2/1980 Conn ..... 222/519
4,251,019 A * 2/1981 Cone ..... 229/103.1
4,324,338 A * 4/1982 Beall ..... 215/6
4,712,702 A * 12/1987 Ayabe et al. ..... 220/706
4,911,315 A * 3/1990 Shrum ..... 215/229
5,076,425 A 12/1991 Plone
5,180,079 A 1/1993 Leng
5,388,712 A * 2/1995 Brody ..... 215/229
5,722,558 A * 3/1998 Thompson ..... 220/521
6,076,729 A * 6/2000 Cornell et al. ..... 229/103.1
6,082,614 A * 7/2000 Schmidt ..... 229/123.3
6,427,864 B1 * 8/2002 Asselin ..... 220/709
6,706,297 B1 * 3/2004 Toth et al. ..... 426/120
6,913,777 B2 * 7/2005 Rebhorn et al. ..... 426/394
2002/0110622 A1 * 8/2002 Lloyd et al. ..... 426/115
2003/0102318 A1 * 6/2003 Lee ..... 220/705
2003/0173237 A1 * 9/2003 Kim ..... 206/217

FOREIGN PATENT DOCUMENTS

JP 62-008951 U 1/1987
JP 63-055906 U 4/1988
JP 63-062359 U 4/1988

OTHER PUBLICATIONS

International Search Report for PCT Application No. PCT/KR2003/002618 dated Feb. 27, 2004.

* cited by examiner

*Primary Examiner* — Jeffrey Allen
(74) *Attorney, Agent, or Firm* — Norris McLaughlin & Marcus, P.A.

(57) ABSTRACT

A food/beverage container has a main body having a main receiving cavity containing contents and a spouting portion for discharging the contents. A sub-receiving cavity is formed in the main receiving cavity to receive other foods. The main receiving cavity and the sub-receiving cavity are separated from each other.

19 Claims, 31 Drawing Sheets

【FIG 20】

CONTAINER FOR FOOD AND BEVERAGE

This is a 371 of PCT/KR2003/002618 filed 1 Dec. 2003 (international filing date), and claims the priority of Korean Application Nos. 10-2002-0076434 filed 30 Nov. 2002 and 10-2002-0080084 filed 10 Dec. 2002.

TECHNICAL FIELD

The present invention relates to a container for food and beverage that has a main receiving cavity and a sub-receiving cavity that are separated from each other.

The present invention relates to a container for food and beverage, which is designed to allow a user to drink beverage through a spouting member or to dispense the beverage to other containers.

The present invention relates to a container having a sub-receiving cavity in which a snack can be stored.

BACKGROUND ART

As instant food and beverage have been developed, a variety of containers proper to the instant food and beverage have been developed.

A conventional container having a dual-cavity comprises a main container body and a sub-container body that is fitted on an upper portion of the main container body. The main container body is for containing beverage and the sub-container body is for containing snack.

However, due to a seal problem, such a conventional container is used only for an instant food. That is, it cannot be used as a seal package for beverage and food. Furthermore, the conventional container is designed not to dispense the beverage to another containers.

Another conventional container comprises a first cup for storing beverage and a second cup inserted into the first cup to store snack. The second cup is provided with a spouting hole.

However, such a conventional container has also a seal problem. In addition, since the spouting hole is designed not to proper for the human body, it is inconvenient to drink the beverage stored in the main cup.

Therefore, there is a need for a container that can be used as a multi-purpose and can preserve the contents for a long time by improving the seal structure.

SUMMARY OF THE INVENTION

Therefore, the present invention has made in an effort to solve the above-described problems of the conventional art.

It is an objective of the present invention to provide a container for food and beverage that has a main cavity and a sub-cavity formed in the main cavity while providing a perfect seal to both of the cavities.

It is another objective of the present invention to provide a container that can allow a user to drink beverage through a spouting member or to dispense the drink to other containers.

To achieve the above object, the present invention provides a food/beverage container comprising a main body having a main receiving cavity containing contents and a spouting portion for discharging the contents; and a sub-receiving cavity formed in the main receiving cavity to receive other foods, wherein the main receiving cavity and the sub-receiving cavity are separated from each other.

The sub-receiving cavity is sealed by a seal member. The spouting portion is closed by a closer.

A spout member is installed in the spouting portion. The spouting portion is provided with an air intake hole.

The spouting portion has a straw insertion hole or a spouting hole. The spouting portion has a cutting film provided with a pulling handle with a cutting line.

The spouting portion includes a folding portion to be bent in a direction. The main body is increased in a diameter as it goes downward.

A bottom of the main body is sealed by a seal member. The main body receives a sub-container body coupled on a top of the main body, the sub-container body defining the sub-receiving cavity and provided with the spouting portion.

The seal member is designed to reseal. The spouting portion includes an operating spouting member slidably inserted in the spouting portion.

The spouting member includes a sub-spouting member. The spouting portion is capable of bending into the sub-receiving cavity.

The sub-container body is tightly coupled to the main body through an insert forming process, a supersonic wave bonding process, a press forming process, or a screw-coupling process.

The main body is a metal can, a paper pack, or a pouch. The sub-container body is provided with a cutting film with a cutting line and a pulling handle coupled on the cutting film.

The sub-container body is provided with a cutting hole and a closer for closing the cutting hole. A paper filter is received in the sub-receiving cavity of the sub-container body.

BEST MODE FOR CARRYING OUT THE INVENTION

Preferred embodiments of the present invention will be described more in detail hereinafter in conjunction with the accompanying drawings.

Figure 1:
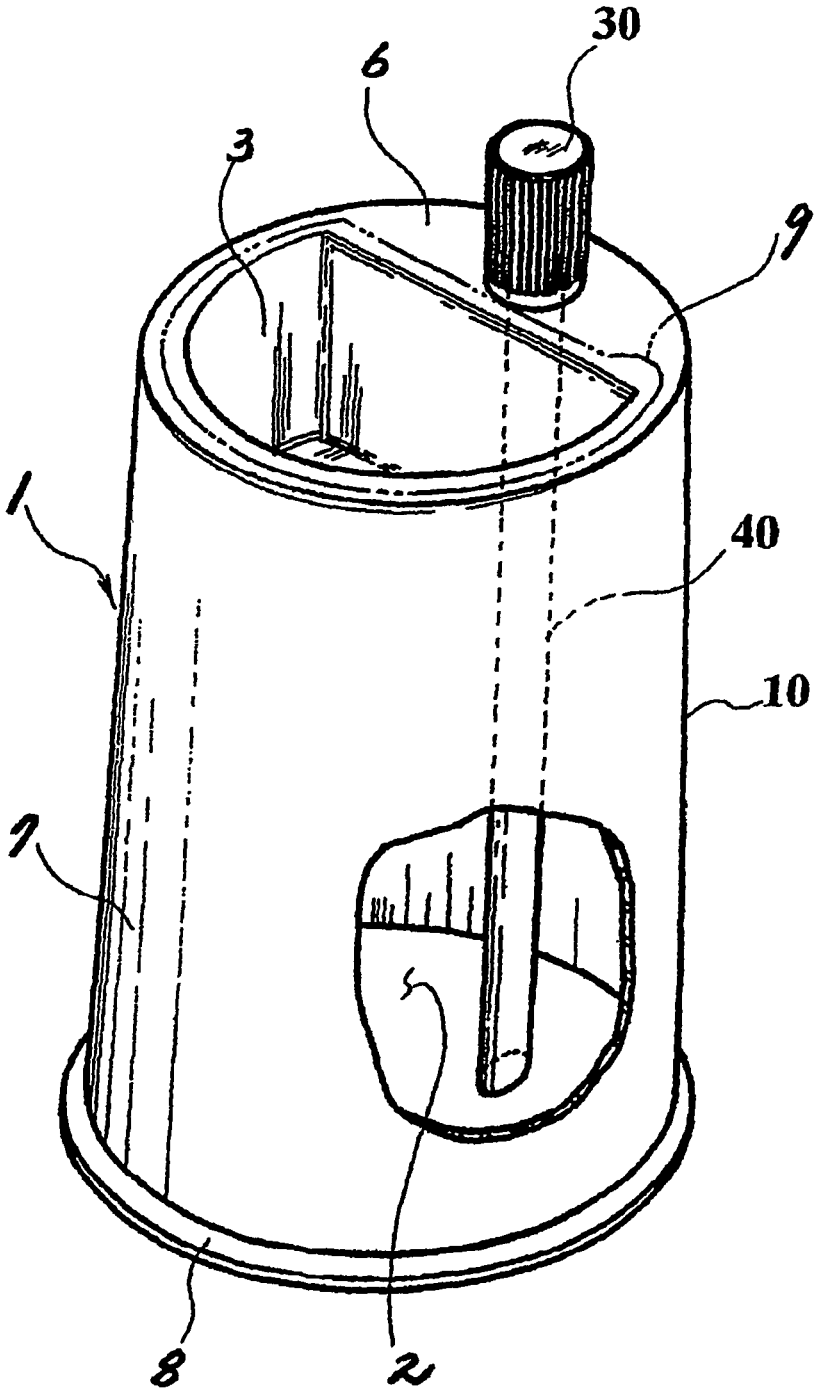
FIG. 1 is a partially broken perspective view of a food/beverage container according to an embodiment of the present invention.

As shown in FIG. 1, a food/beverage container 1 of the present invention comprises a main receiving cavity 2 for containing liquid material and a main body 10 defining the main receiving cavity 2 and provided with a spouting portion for spouting the liquid material. The main body 10 includes a sub-receiving cavity 3 defined by a top concaved into the main receiving cavity 2.

The main receiving cavity 2 is separated from the sub-receiving cavity 3.

A closer 30 is coupled on the spouting portion formed beside the sub-receiving cavity 3. A spouting member 40 is installed through the spouting portion.

The main body 10 includes a top portion 6 and a side portion 7. A circumferential flange 8 is formed on a lower end of the side portion 7.

Liquid material is fed through a lower end of the main body 10. A seal member (not shown) is attached on the circumferential flange 8 to provide a seal to the main body 10.

In use, the closer 30 is opened so that a user can suck the spouting member 40 to drink the liquid material.

In the sub-receiving cavity 3, snack can be stored. Therefore, after removing a seal member, the user can eat the snack while drinking the liquid material.

Since the main body 10 is designed having a wide-top and a narrow-bottom, many main bodies can be stacked one another for the delivery.

The liquid material can be filled in the main body through the spouting portion in a state where the bottom is sealed and the closer is opened.

Figure 2:
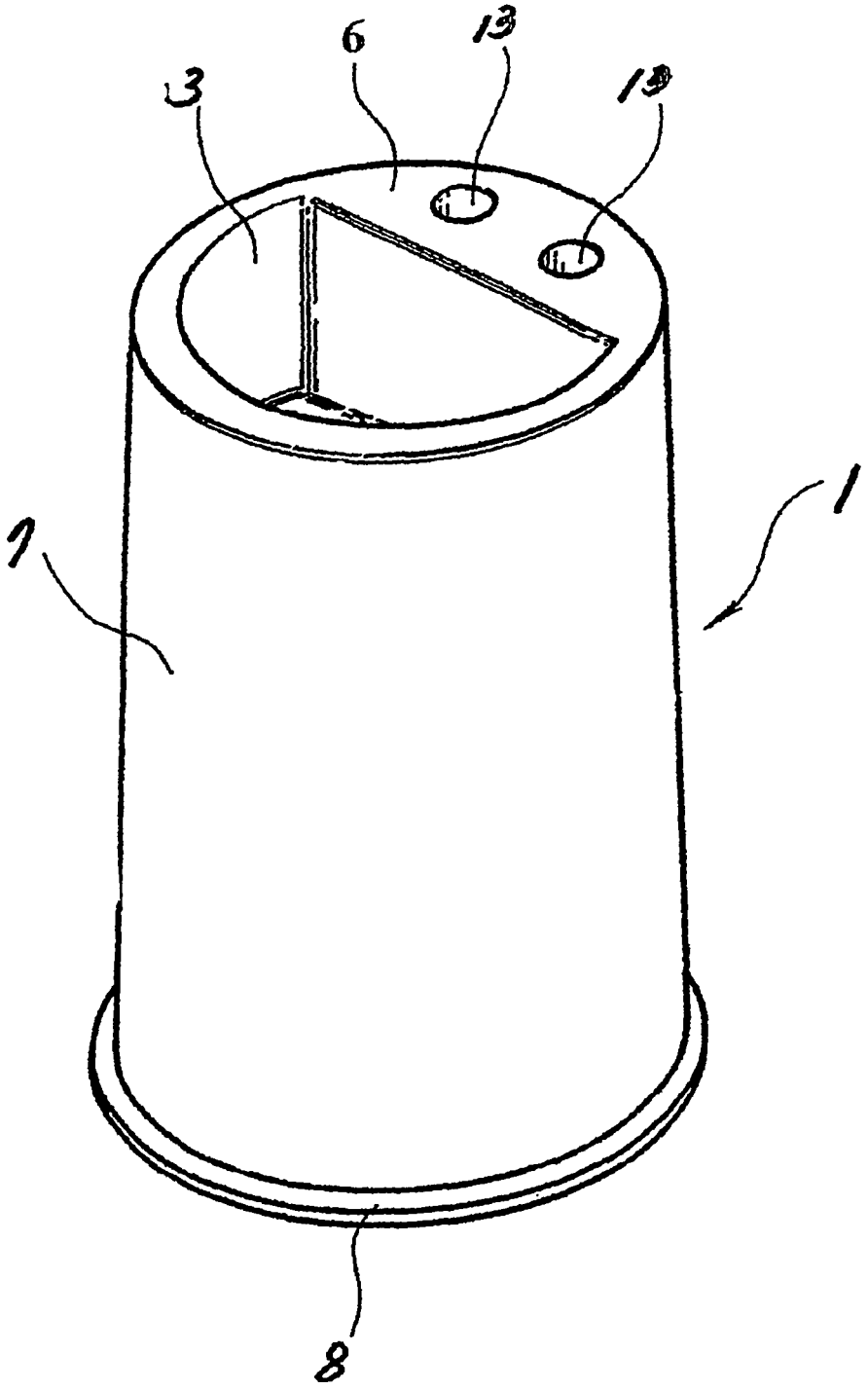
FIGS. 2 through 4 are perspective views of a variety of embodiments of spouting portions of the present invention.
Figure 3:
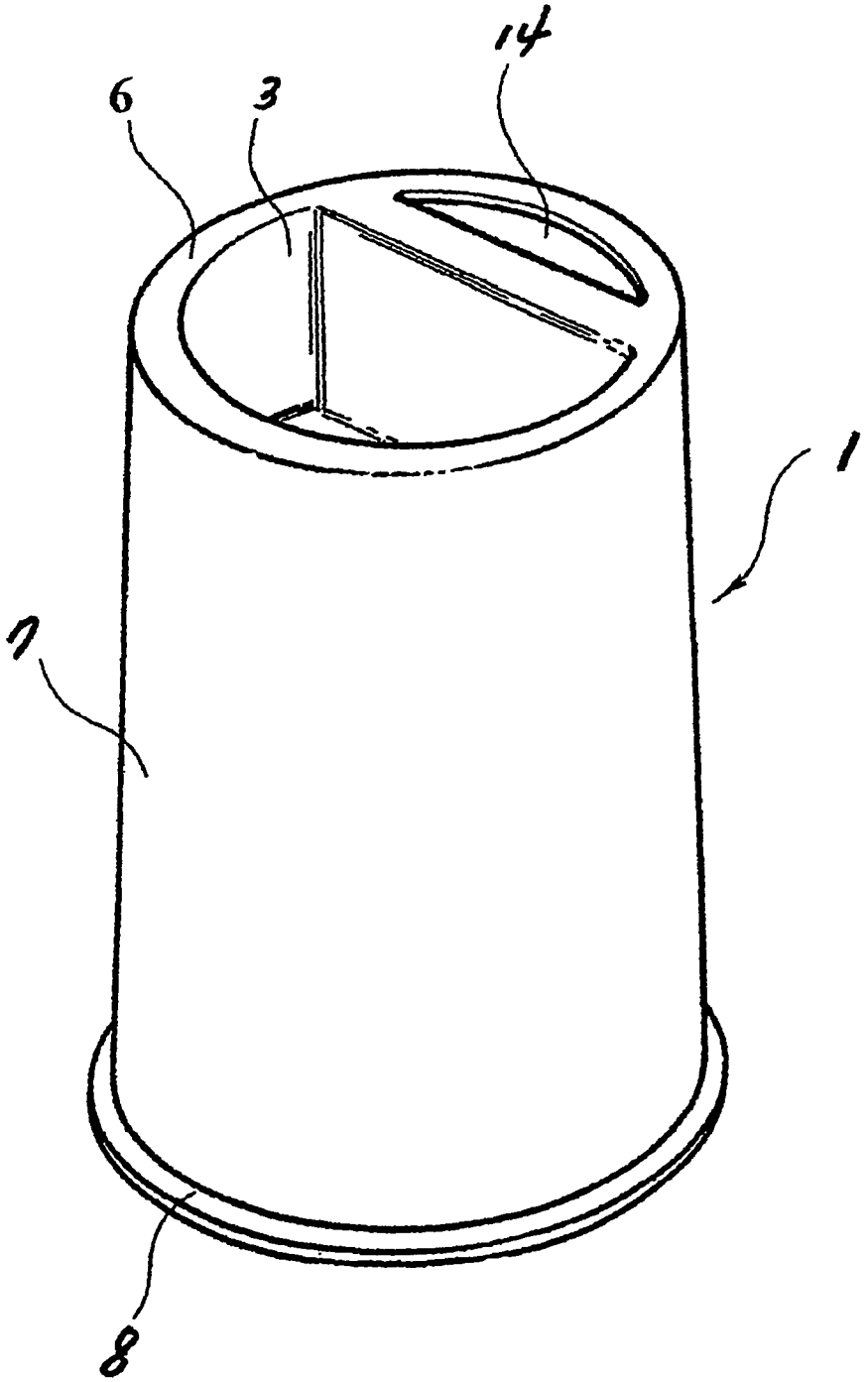

In another embodiment, as shown in FIG. 2, the top 6 of the main body 10 is provided with a plurality of straw insertion holes 13. In another embodiment, as shown in FIG. 3, a spouting hole may be formed on the top so that the user can selectively use the straw through the spouting hole.

Figure 4:
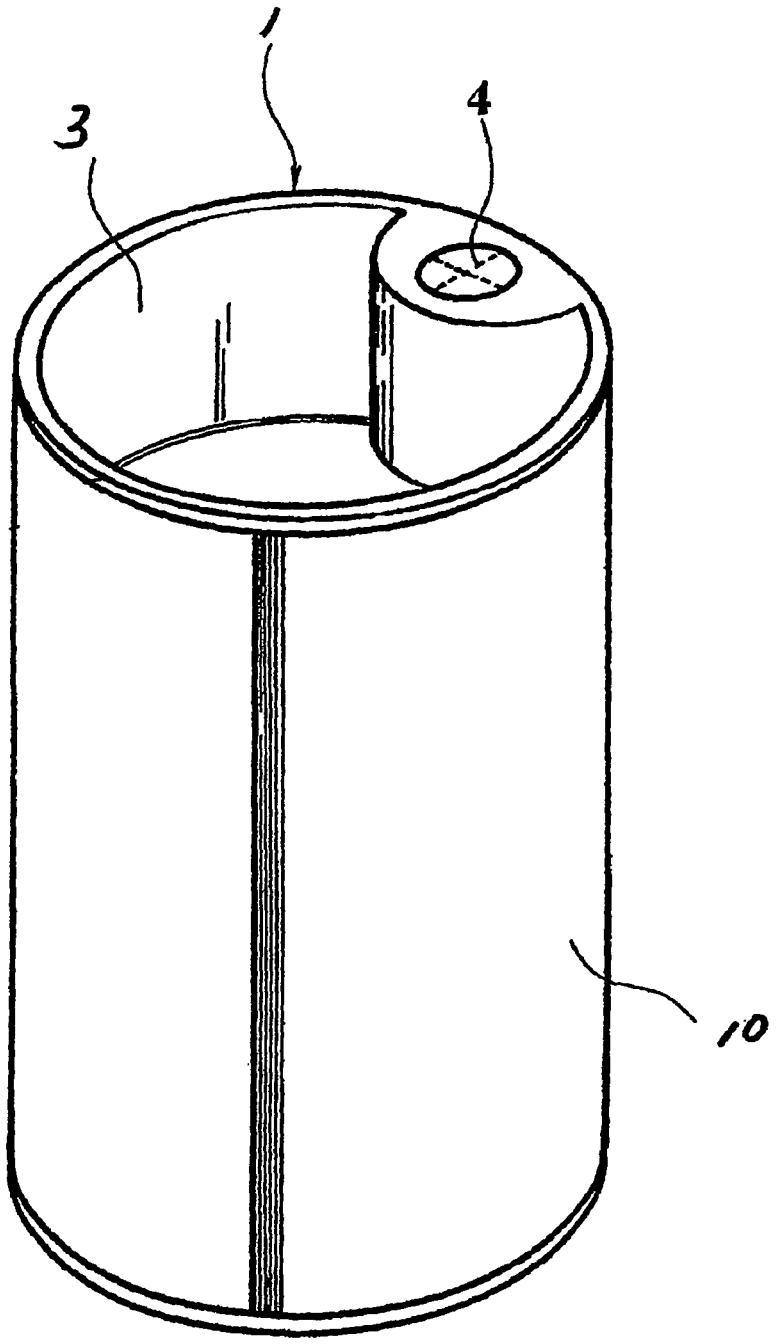

As shown in FIG. 4, the top of the main body is provided with a thin layer 12 through which the straw can penetrate. The thin layer 12 may be provided with a cutting line.

Figure 5:
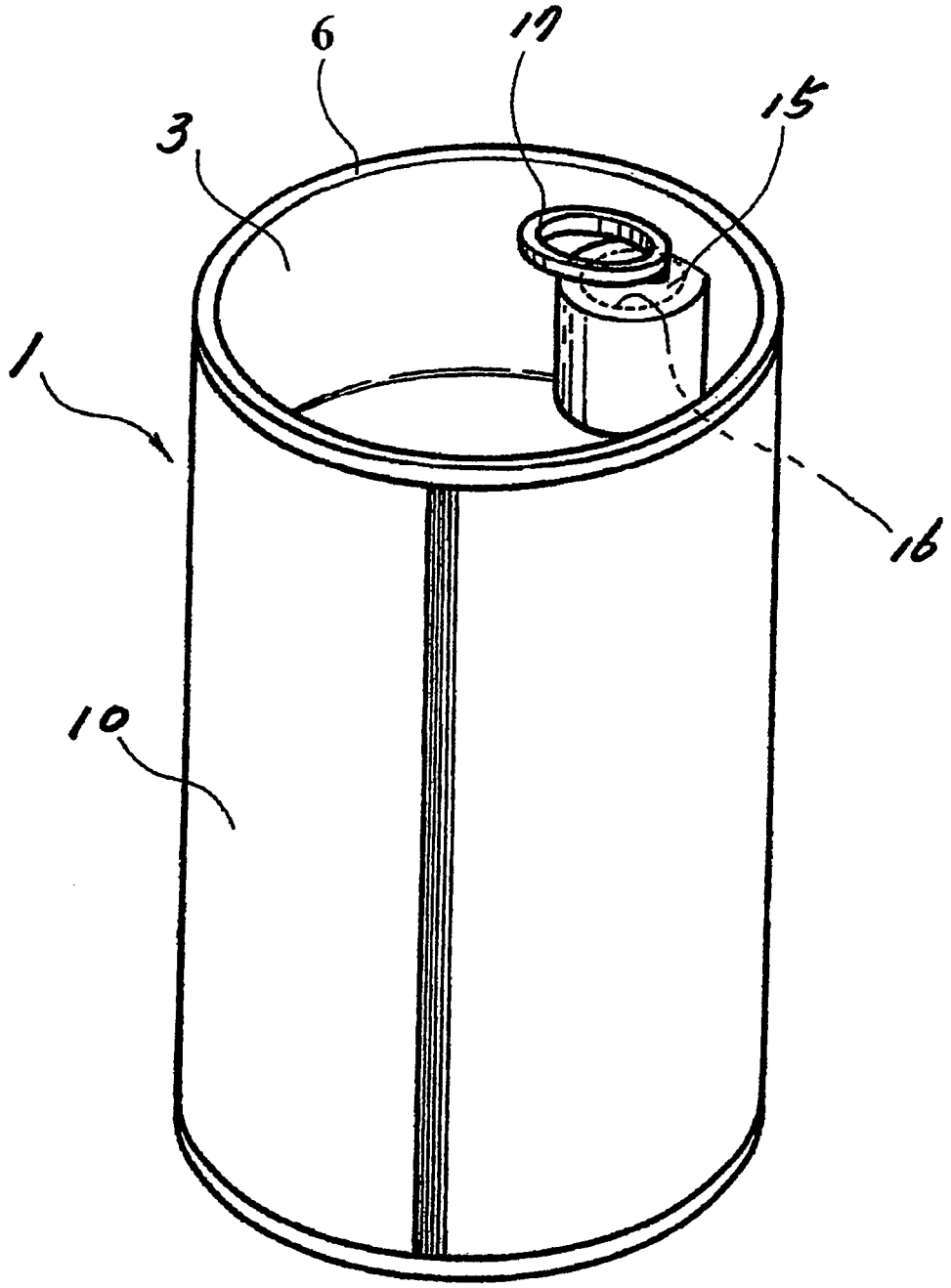
FIG. 5 is a perspective view of another embodiment of the present invention.

As shown in FIG. 5, the spouting portion is formed in the sub-receiving cavity 3. The spouting portion is formed of a cutting layer integrated with a pulling handle 17.

Figure 6:
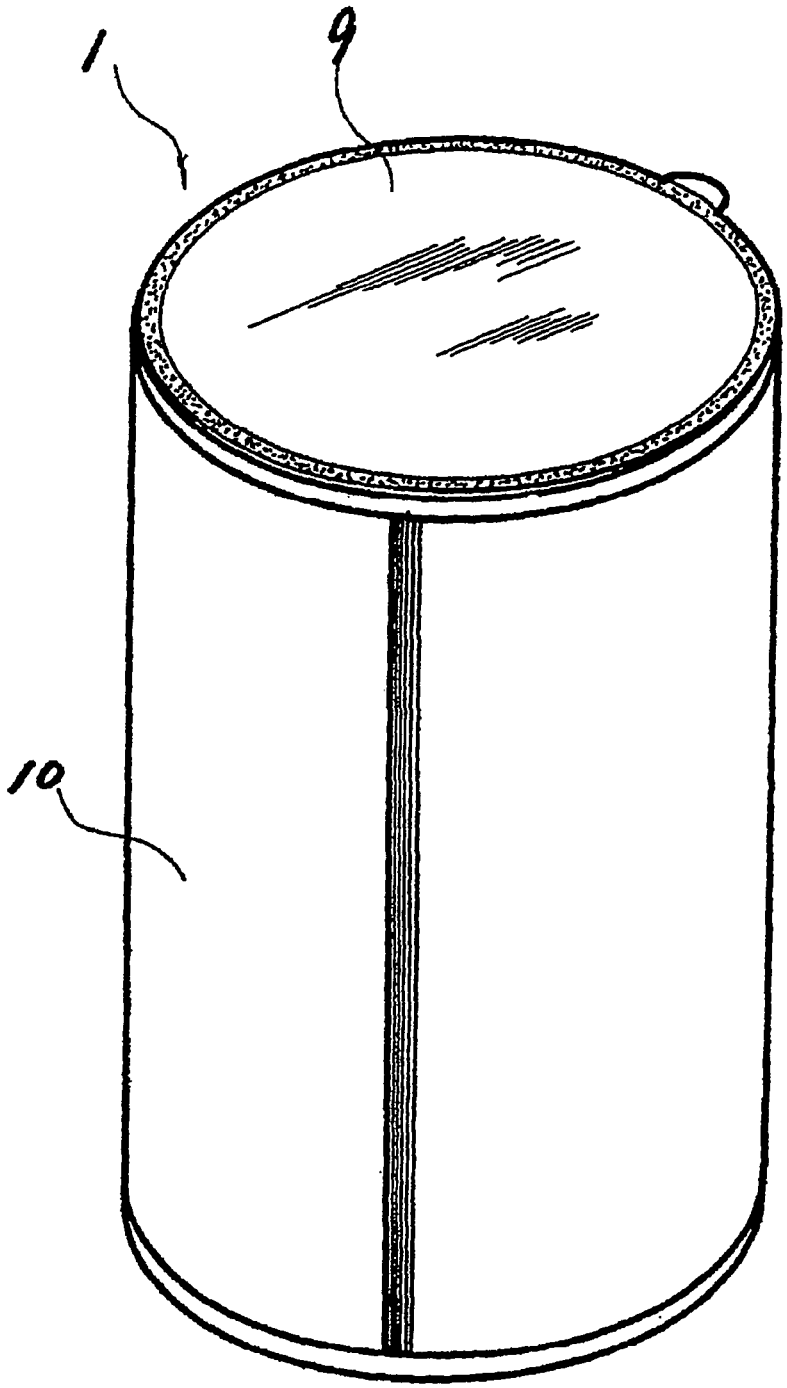
FIGS. 6 and 7 a perspective view of a using state of FIG. 5.
Figure 7:
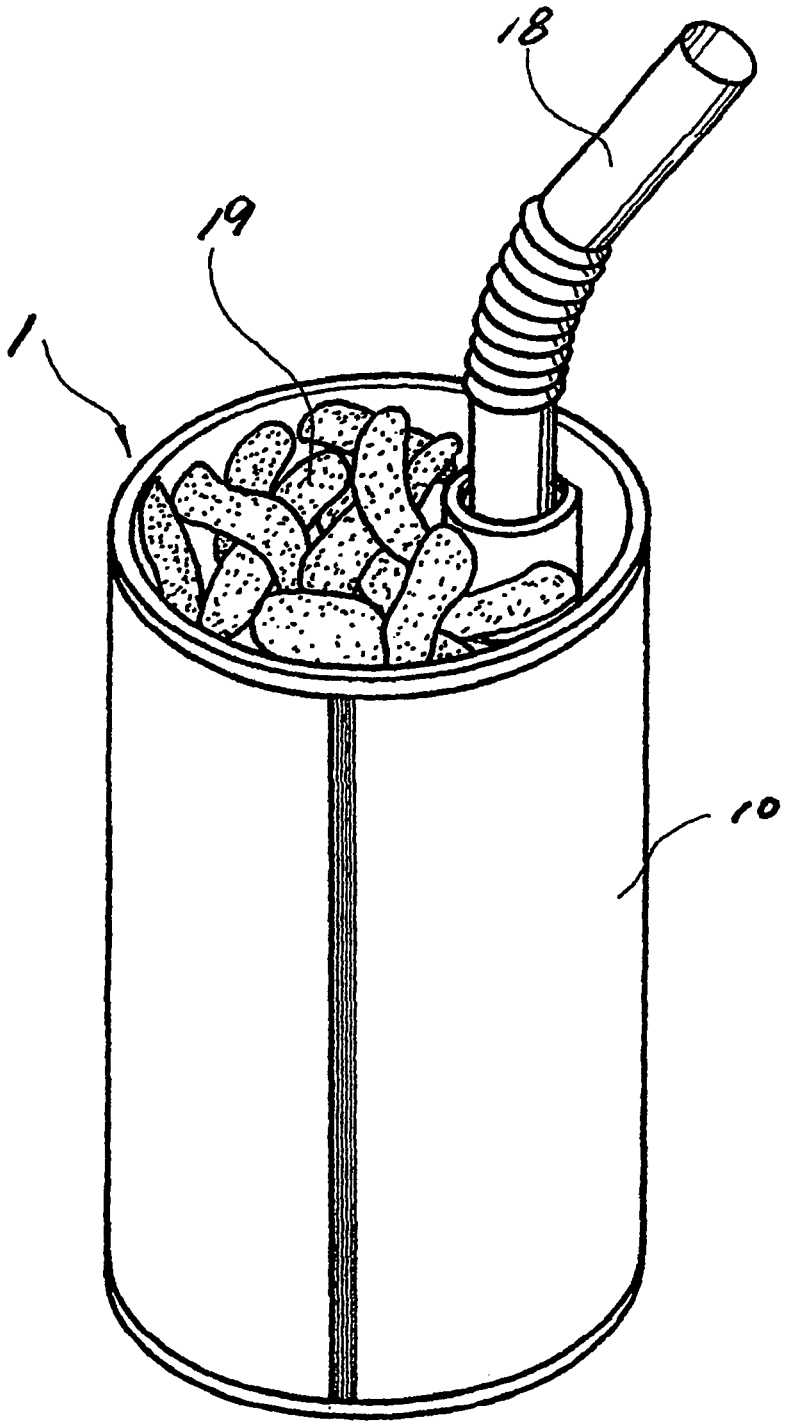

As shown in FIG. 6, snack is filled in the sub-receiving cavity 3 and the seal member 9 is attached on a top of the sub-receiving cavity 3. In use, after removing the seal member 9, the cutting layer 15 is removed by pulling the pulling handle 17. A straw is inserted into a hole defined by removing the cutting layer 15.

Figure 8:
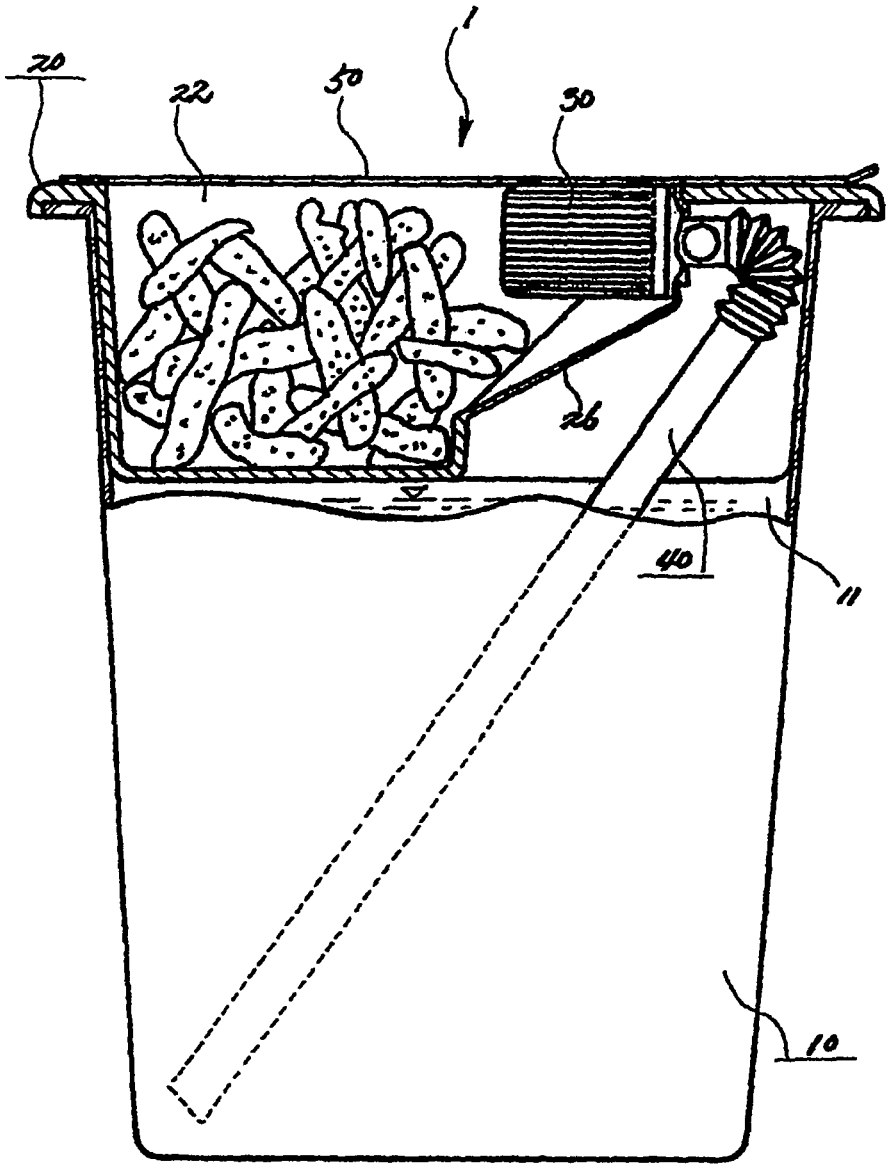
FIG. 8 is a sectional view of another embodiment of the present invention.

FIG. 8 shows another embodiment of the present invention.

As shown in the drawing, the food/beverage container 1 of this embodiment includes a main body 10 provided with a main receiving cavity 11. a sub-container body 20 is associated with a top of the main body 10. That is, the main body 10 is provided with a coupling circumferential flange 12 at its top.

The sub-container body 20 is provided with a circumferential flange 21 corresponding to the circumferential flange of the main body 10. The sub-container body 20 is provided with a sub-receiving cavity 22 and a spouting portion 23 is formed beside the sub-receiving cavity 22. The spouting portion 23 is provided with a folding portion so that the spouting portion 23 can be bent toward the sub-receiving cavity 22 based on a connecting portion 25 between the spouting portion and the top portion 24.

The spouting portion 23 is closed by a closer 30 through a screw or fitting manners.

A spouting member 40 is assembled through the spouting portion 23 to discharge the content in the main receiving cavity 11 of the main body 10. The spouting member 40 includes an operation part 41 corresponding to an insertion hole of the spouting portion 23. The operation part 41 is provided at a lower end with a circumferential projection 42 and a side through hole 41 formed above the circumferential projection 42. Another circumferential projection 45 is also formed on an upper portion of the operation part 41. The circumferential projection 42 can be formed as a folding portion 43.

The operation of the above-described present invention will be described hereinafter.

Liquid material is filled in the main receiving cavity 11 of the main body 10 and the sub-container body 20 having the spouting portion 23 closed by the closer 30 is associated with the main body 10.

Snack is filled in the sub-receiving cavity 22 of the sub-container body 20, and is sealed by the seal member 50 such as an aluminum film.

Before the seal using the seal member 50, the spouting portion 23 is bent into the sub-receiving cavity 22.

Figure 9:
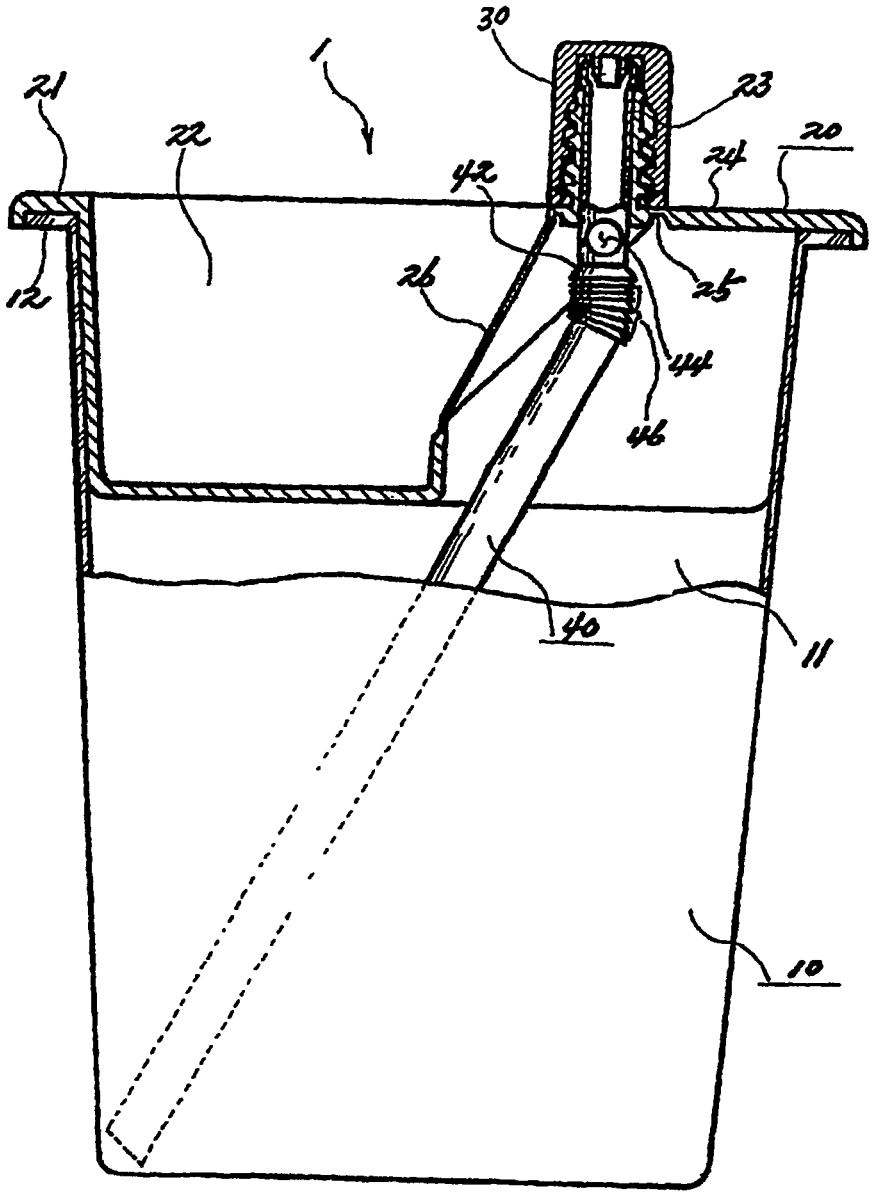
FIGS. 9 through 11 are sectional views of a using state of FIG. 8.

In use, after removing the seal member 50, the spouting portion 23 is elected (see FIG. 9). To drink the liquid material in the main receiving cavity 11, the closer 30 is opened (see FIG. 10). When the user sucks the spouting member 40, the liquid material is spouted through the spout member 40.

Here, the side through hole 44 is closed by the insertion hole wall of the spouting portion 23, the liquid material can be spouted through the spout member 40. An air intake passage may be formed on an outer wall of the spouting member 40 to prevent the formation of vacuum during drinking the liquid material.

Figure 11:
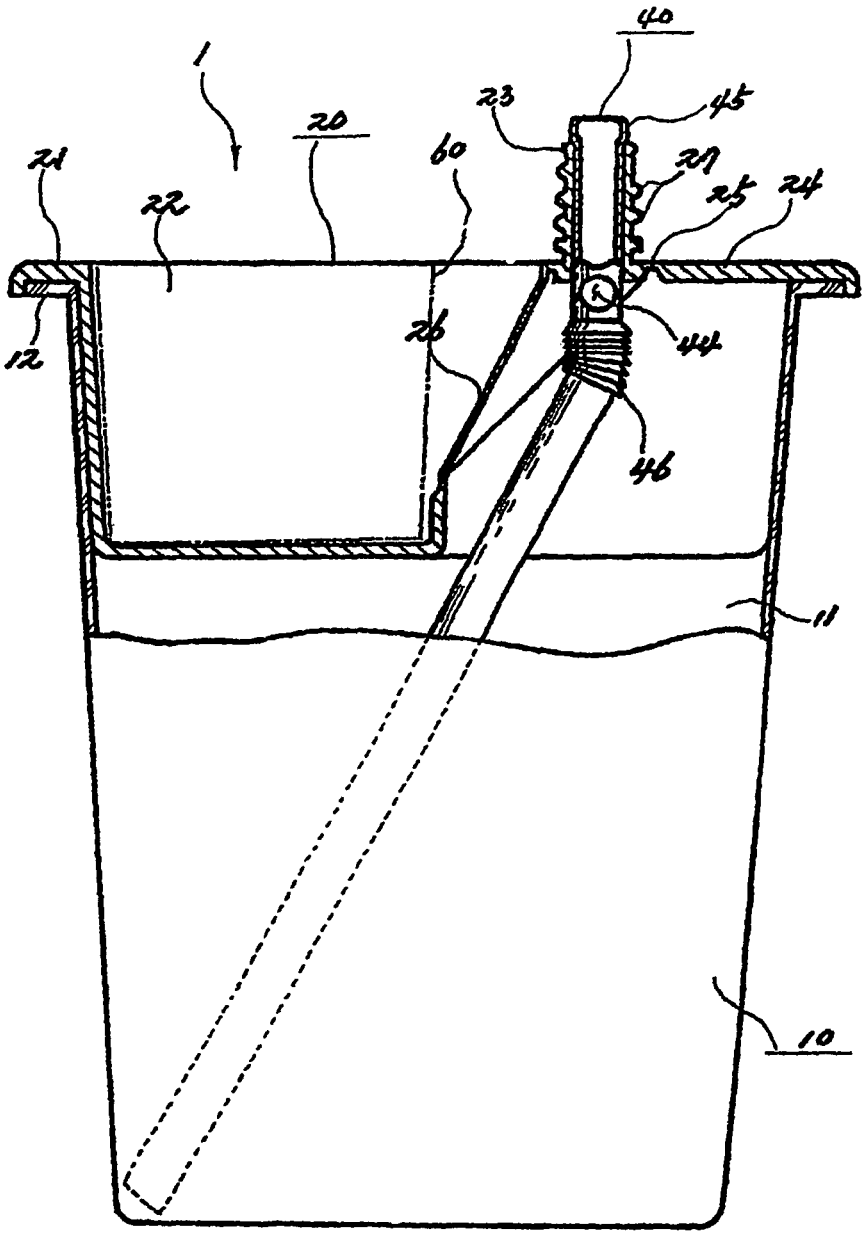

In order to dispense the liquid material to another container, the spout member 40 is pushed down as shown in FIG. 11 to open the side through hole of the spout member 40.

In this state, when the container 1 is inclined or upside-down, the liquid material can be spouted through the side through hole 44 and the spout hole 43.

Figure 10:
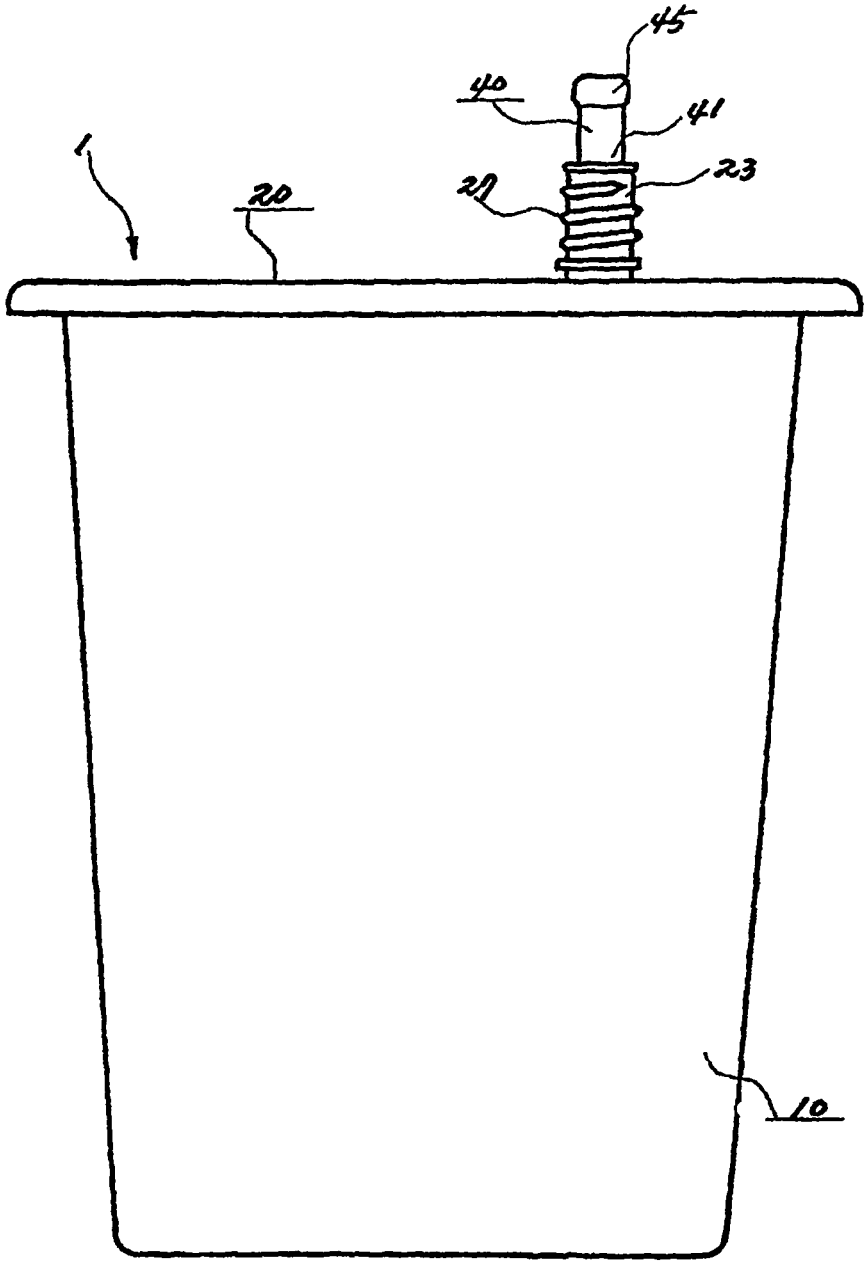

In a state shown in FIG. 10, the snack contained in the sub-receiving cavity 22 may drop. However, this can be prevented by a variety of method. For example, the sub-receiving cavity 22 may be designed to be reclosed or a sub-closing container 60 may be provided.

As described above, the container 1 is designed to drink beverage while eating snack.

Figure 12:
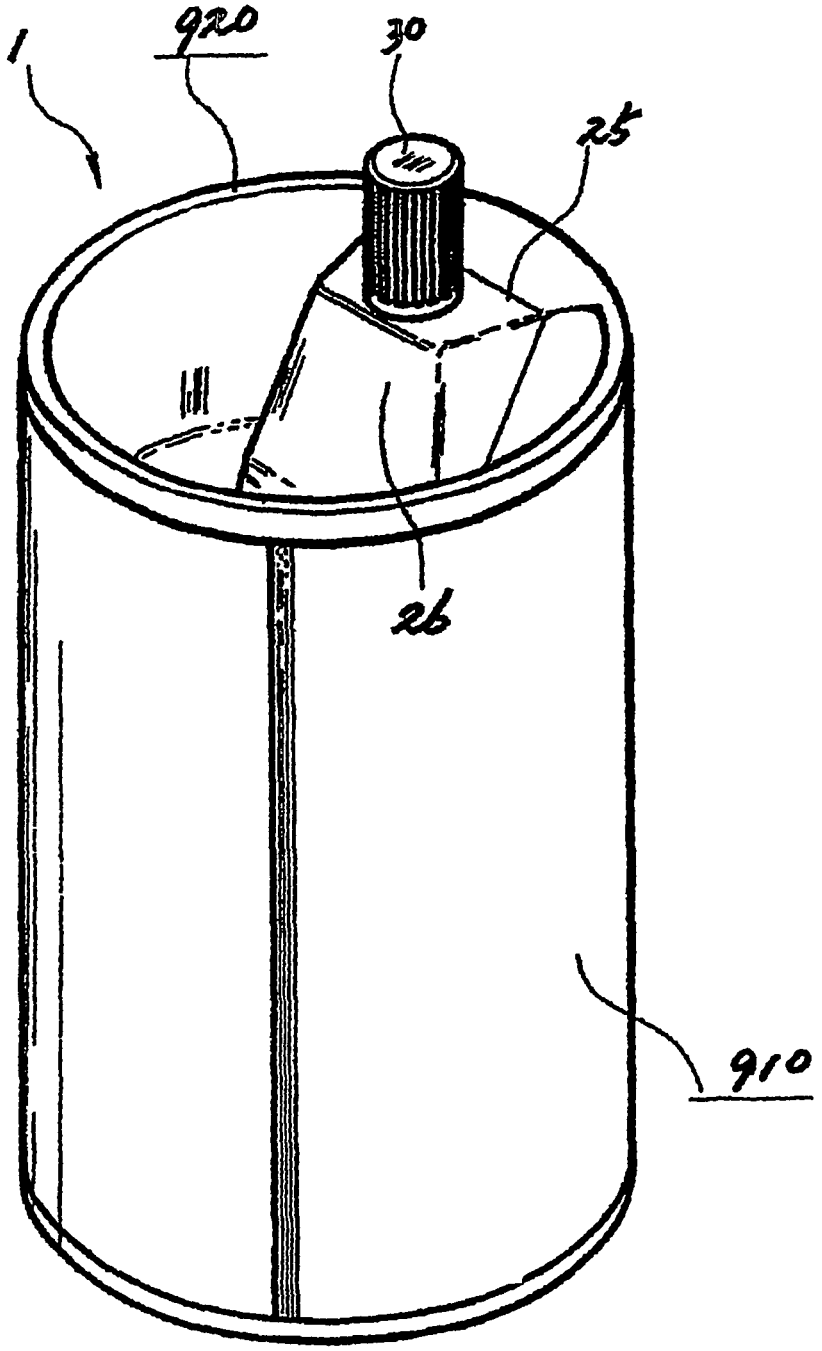
FIGS. 12 through 15 are perspective views of a coupling structure of a sub-container of the present invention.

In another embodiment of the present invention, as shown in FIG. 12, a sub-container body 920 is integrated with a main body 910 through an insert forming process.

Figure 13:
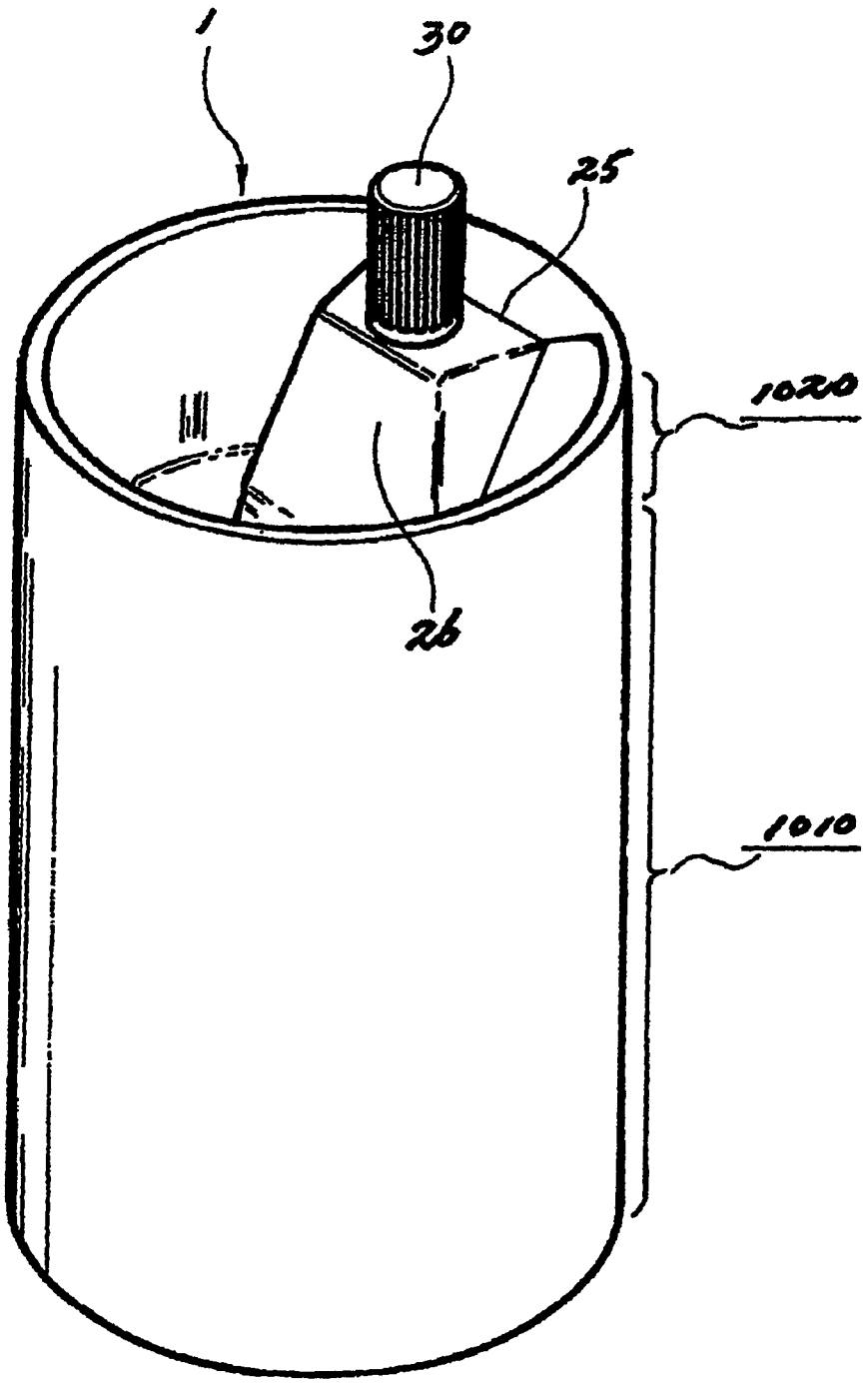

FIG. 13 shows a food/beverage container 1 having a main body 1010 and a sub-container body 1020 that are integrally formed through, for example, a direct blow or an injection blow. This has an advantage of reducing the cots.

Figure 14:
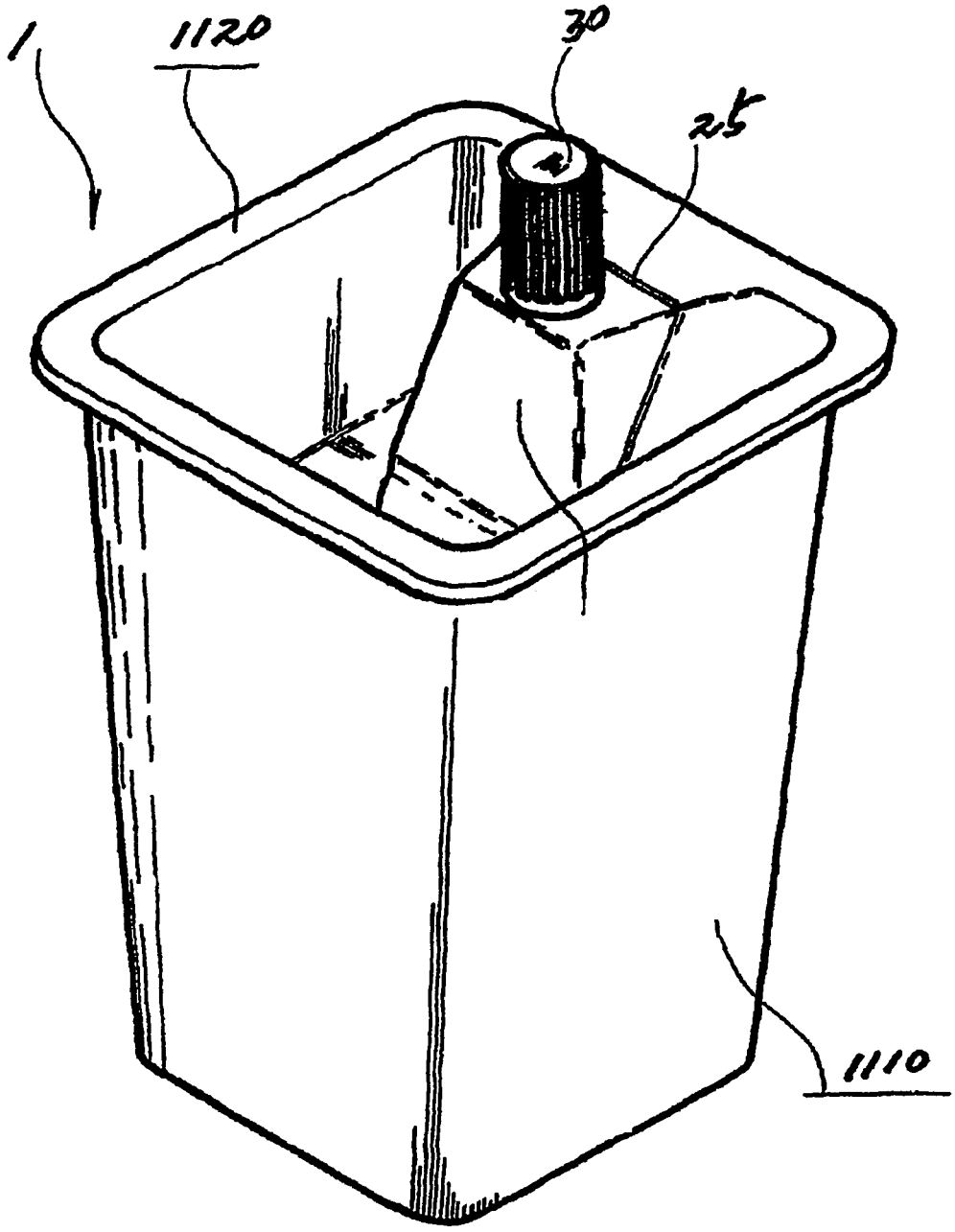

FIG. 14 shows a food/beverage container 1 formed in a polygonal shape. The main body 1110 and the sub-container body 1120 are formed in a square shape.

Figure 15:
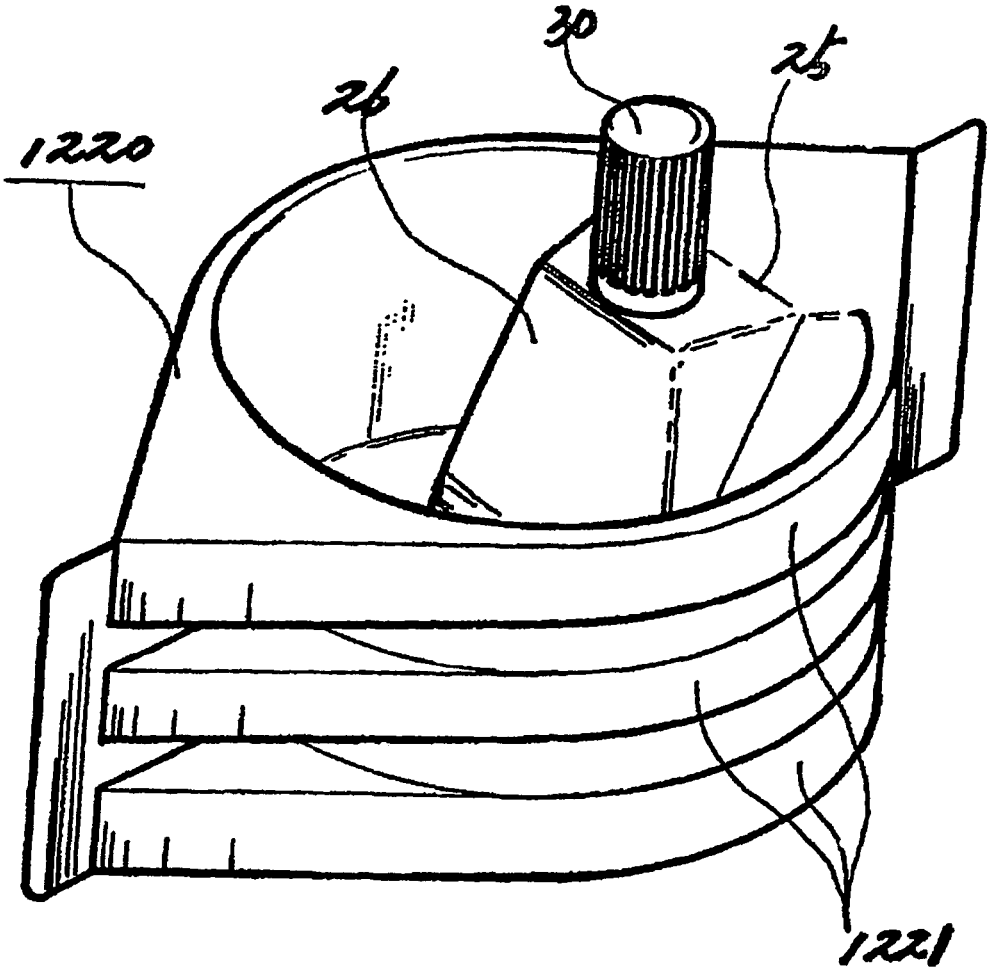

FIG. 15 shows a container 1 having a sub-container body 1220 having a fitting portion 1228 fitted on a flexible pouch.

Figure 16:
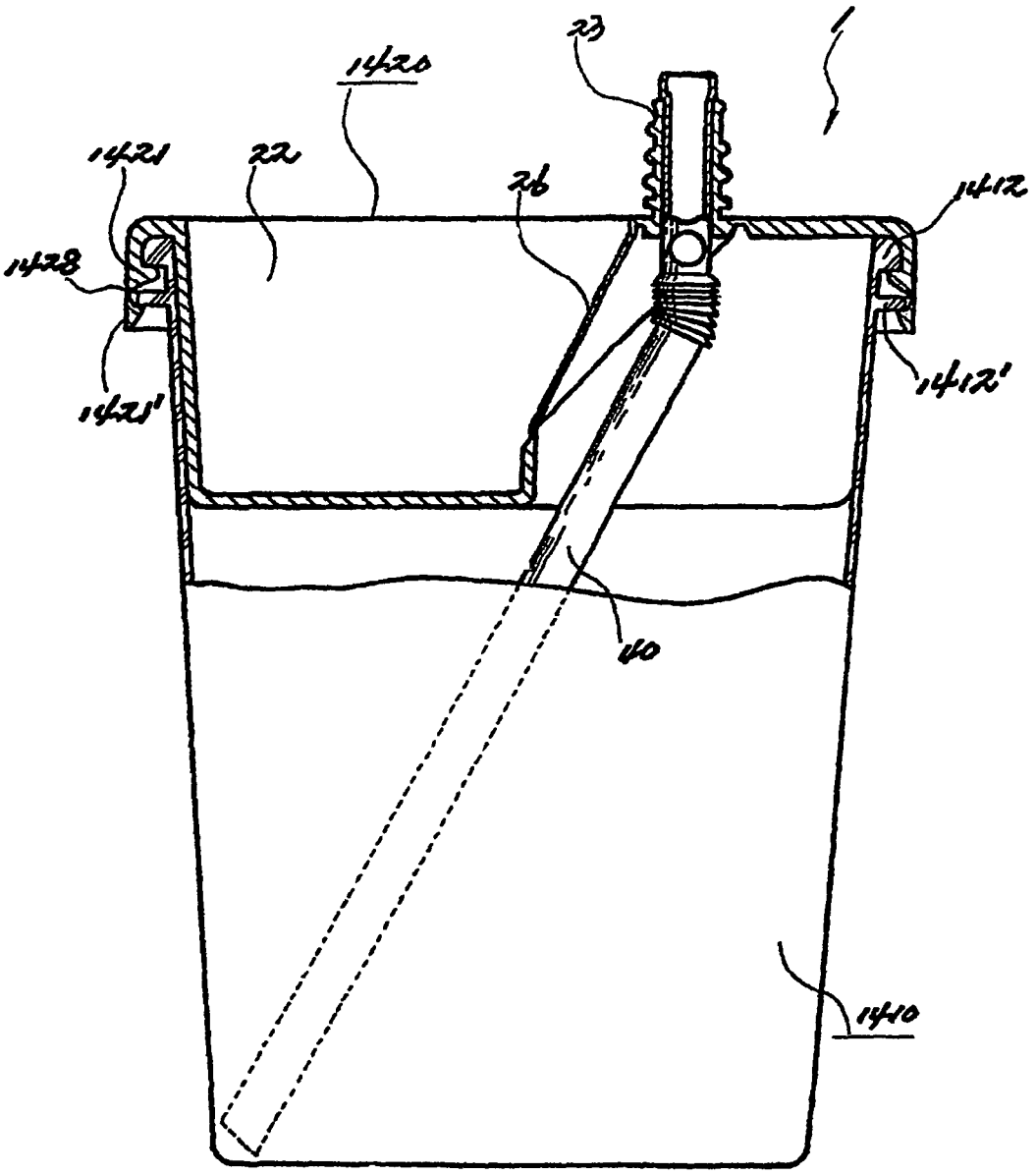
FIGS. 16 through 18 are sectional views of another coupling structure of a sub-container of the present invention.

FIG. 16 shows a container having a sub-container body 1420 coupled on a main body 1410 in a one-touch opening method. That is, circumferential projections 1412 and 1412' are formed on a top of the main body 1410 and the sub-container body 1420 is provided with coupling portions 1421 and 1421' that are fixed on the circumferential projections 1412 and 1412'.

Figure 17:
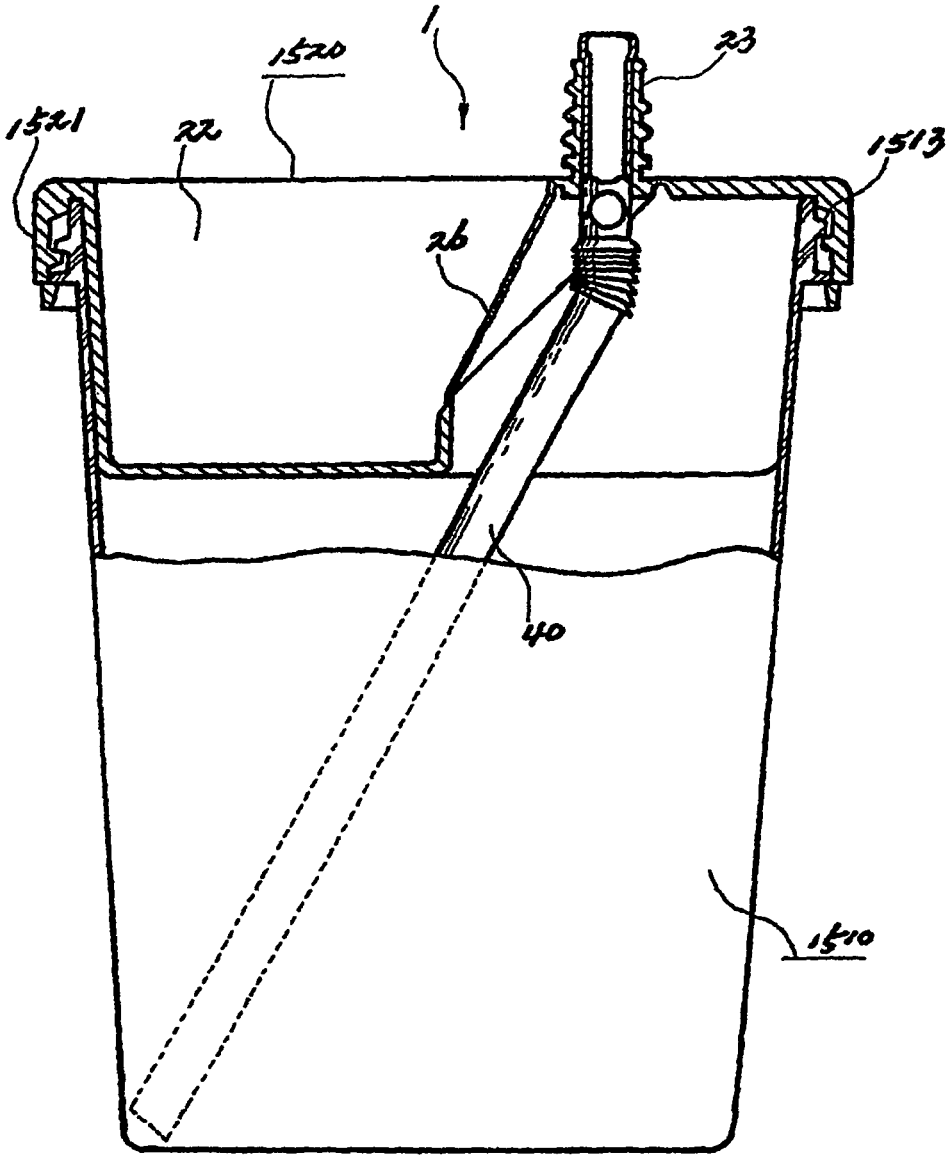

FIG. 17 shows a sub-container body 1520 that is screw-coupled on a main body 1510. That is, a thread is formed on an upper end of the main body 1510, and the sub-container body 1520 is also provided with a thread coupled with the thread 1513 of the main body 1510.

Figure 18:
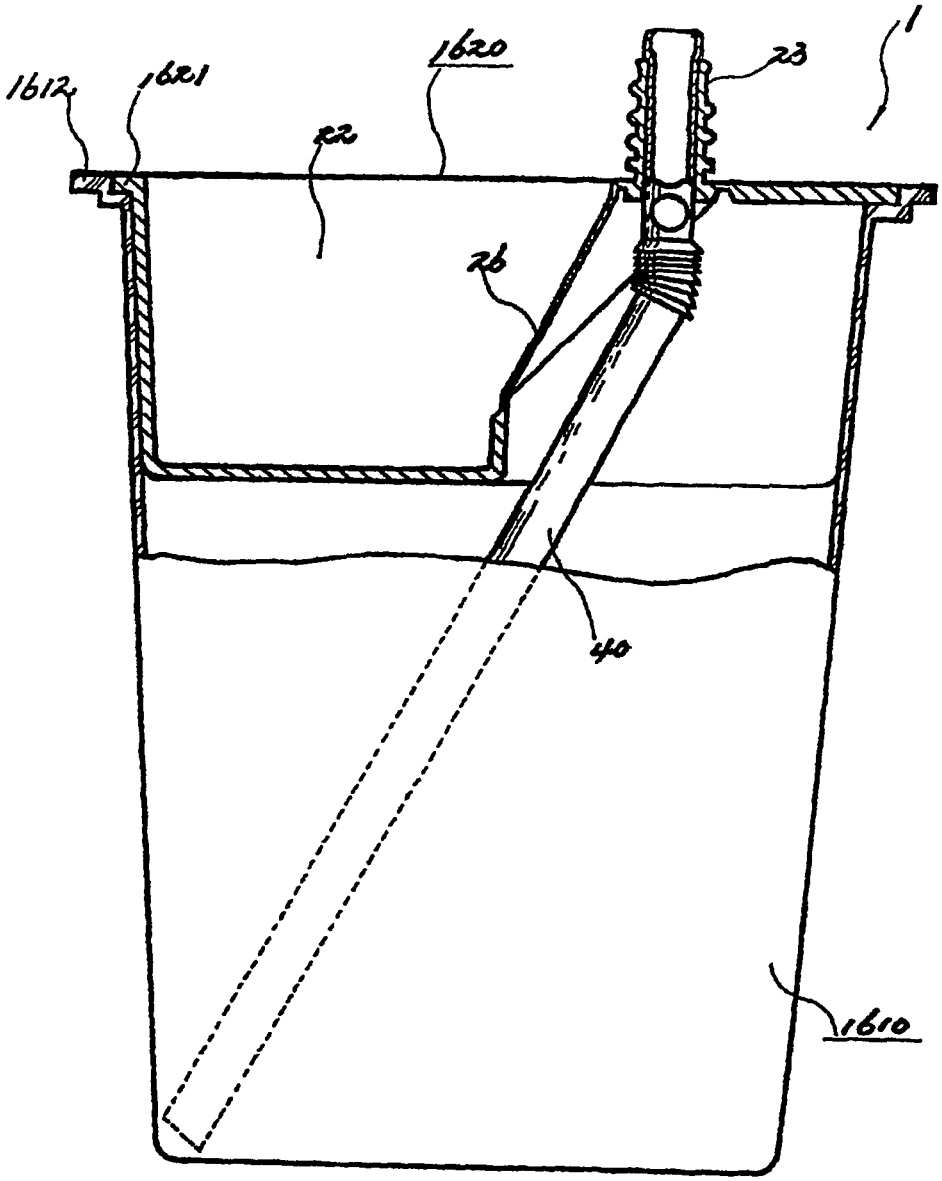

FIG. 18 sows a container in which a sub-container body 1620 functions as a seal member by coupling on a top of a main body 1610. That is, a circumferential step 1612 is formed on a top of the main body 1610, and the sub-container body 1620 is provided with a circumferential projection interlocked with the circumferential step 1612 of the main body, thereby providing a seal to the main body.

Figure 19:
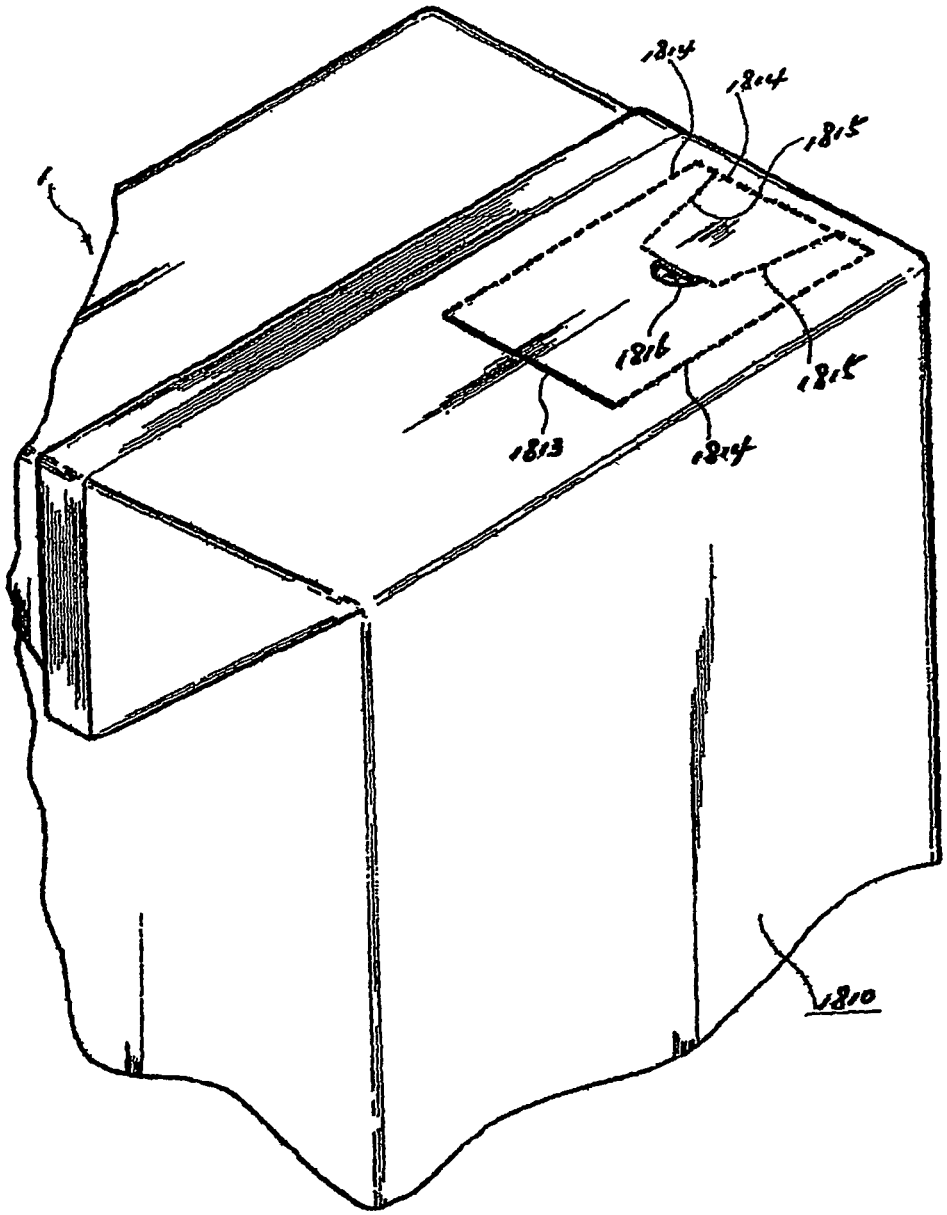
FIGS. 19 through 20 are perspective views of a main body according to another embodiment of the present invention.
Figure 20:
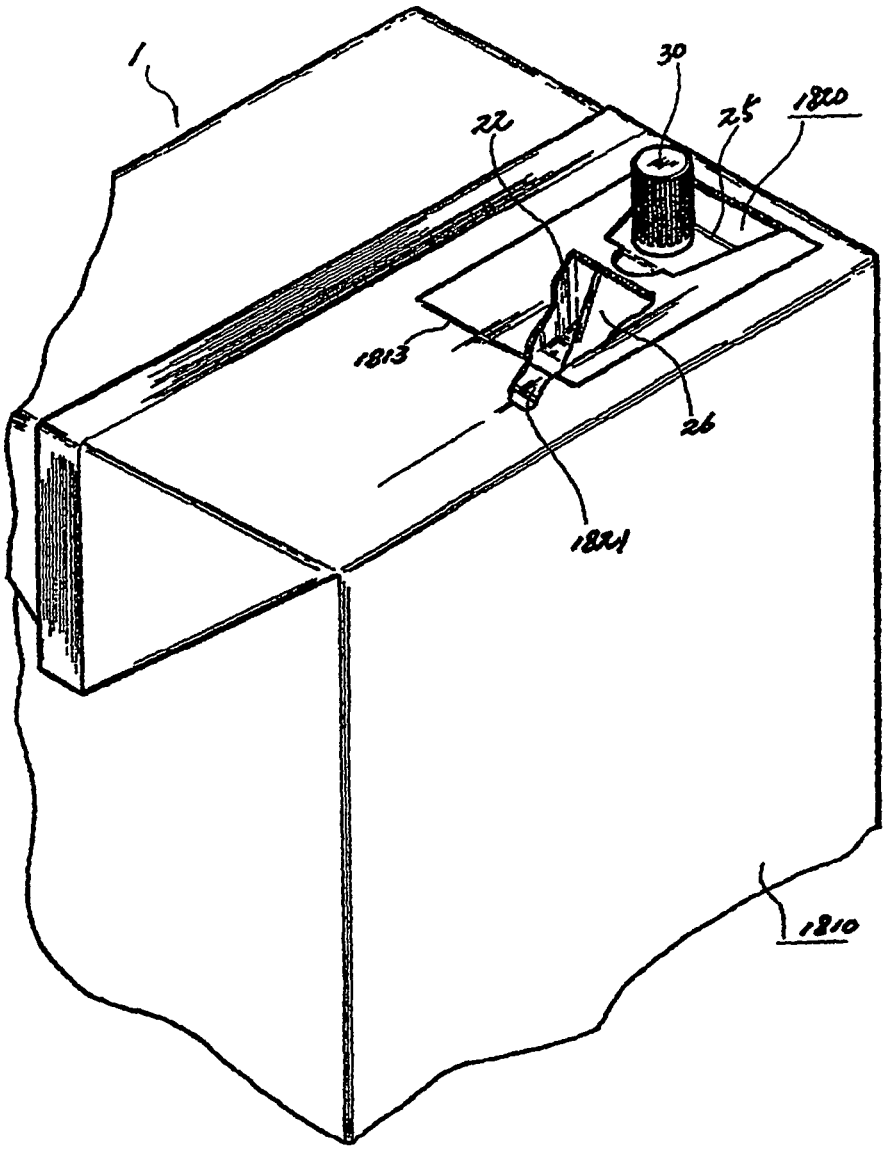

FIGS. 19 and 20 show a container having a main body 1810 and a sub-container body 1820 coupled on an inner surface of the main body 1810 by a coupling portion 1821. The coupling portion 1821 is provided with a cutting line so that the sub-container body 1820 can be easily opened.

That is, a cutting line 1814 is formed around a folding line 1813 and a sub-cutting line 1815 for cutting the cutting line 1813 and reclosing the sub-receiving cavity 22 is also formed. A guiding portion 1816 formed of a thin film is also provided to cut the sub-cutting line 1815.

In use, when the guide portion 1816 is pulled toward a portion where the sub-cutting line 1815 is formed, the sub-cutting line 1815 and the cutting line 1814 are cut to remove a portion of the main body 1810.

In this state, when further pulling the remained portion, the cutting line 1814 is cut to open the sub-receiving cavity 22. As shown in FIG. 20, the cut portion can be used to reclose the sub-receiving cavity 22 after the closer 30 is elected.

Figure 21:
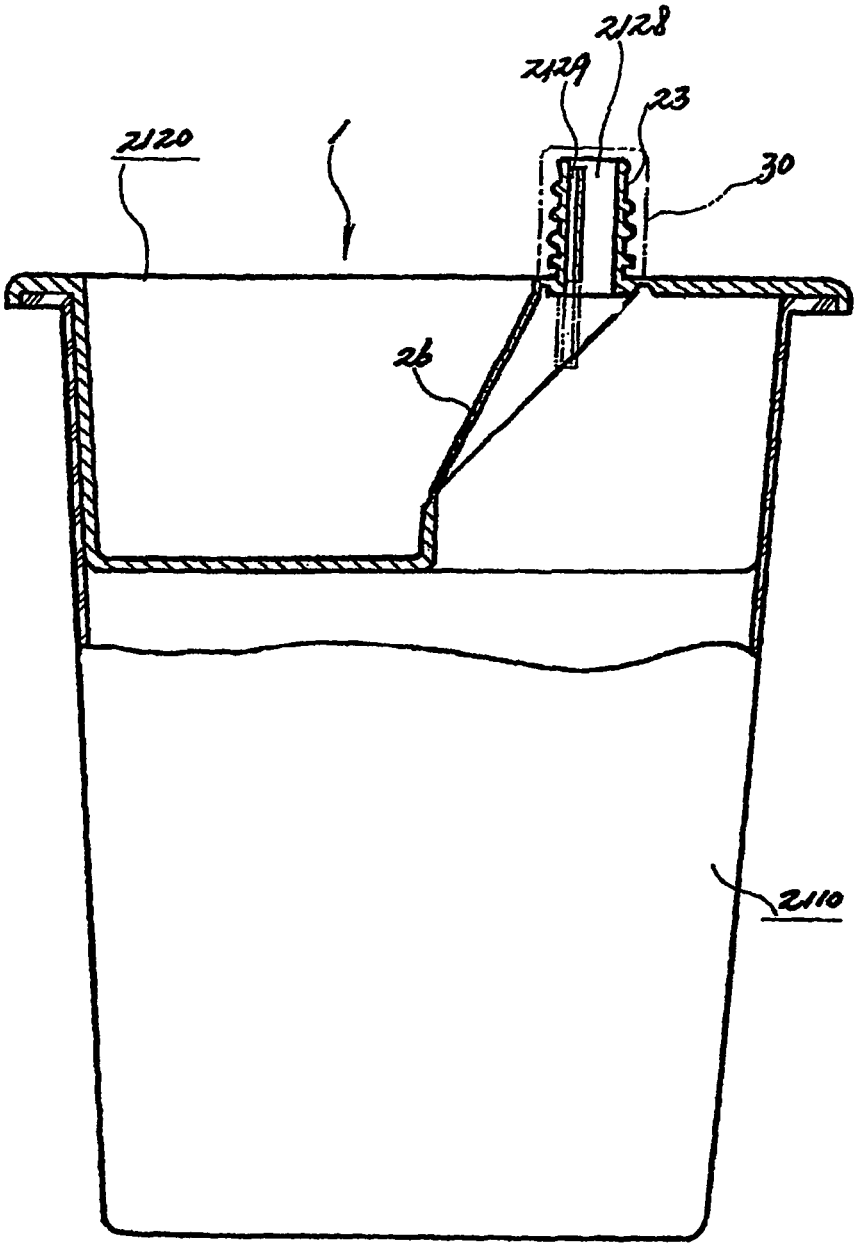
FIGS. 21 through 25 are sectional views of another embodiment of a spouting portion of the present invention.

In another embodiment, as shown in FIG. 21, there is provided a spouting portion 23 provided with a spouting hole 2128. An air intake hole 2129 is provided on a wall defining the spouting hole 2128. In use, when the container 1 is inclined, the liquid contents in the main container 2110 is spouted and air is introduced into the main container 2110 through the air intake hole 2129 to allow the liquid content can be effectively spouted.

Figure 22:
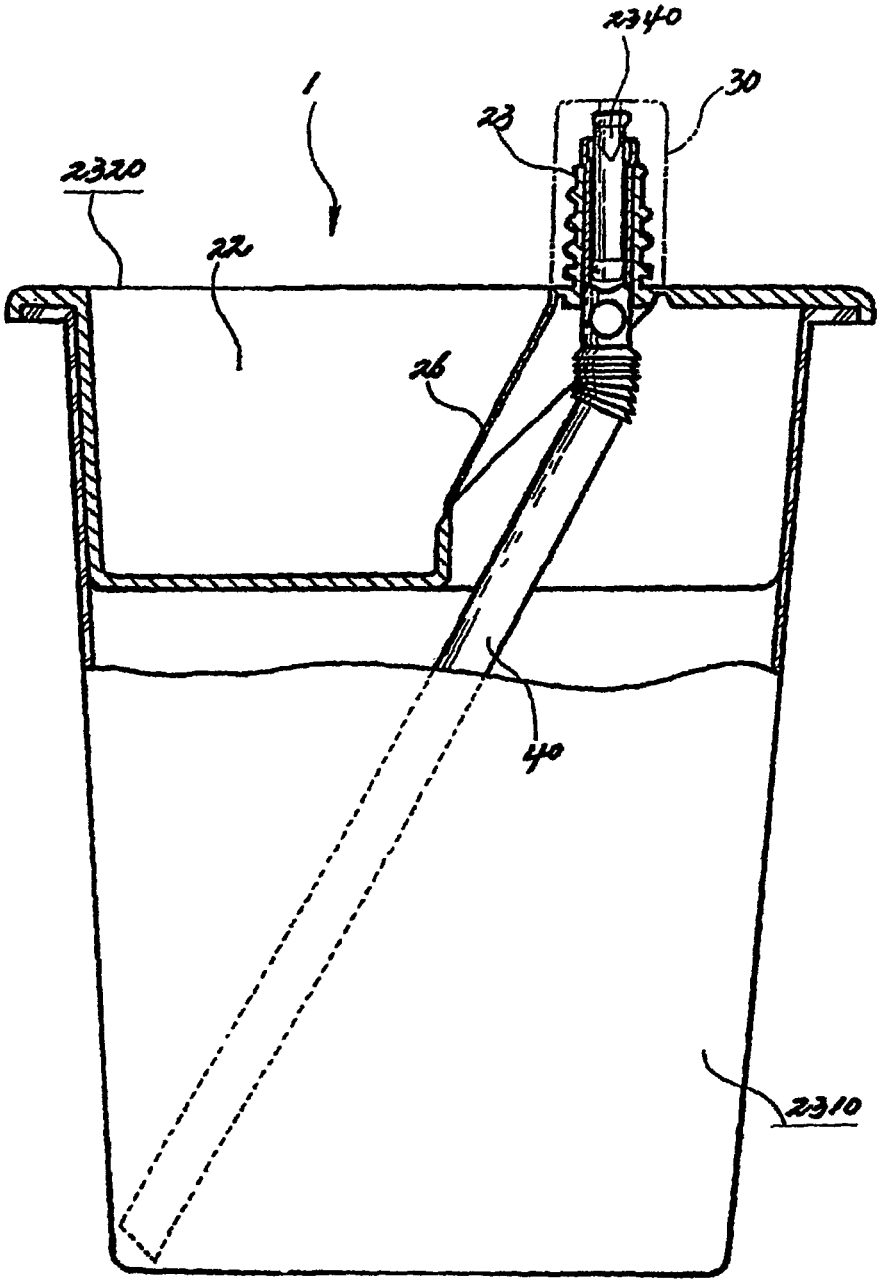

FIG. 22 shows an operating spouting member 2340 that is vertical movable in the spouting portion 23. In use, the operating spouting member 2340 can be projected outward, making it easy for a user to easily drink the content.

Figure 23:
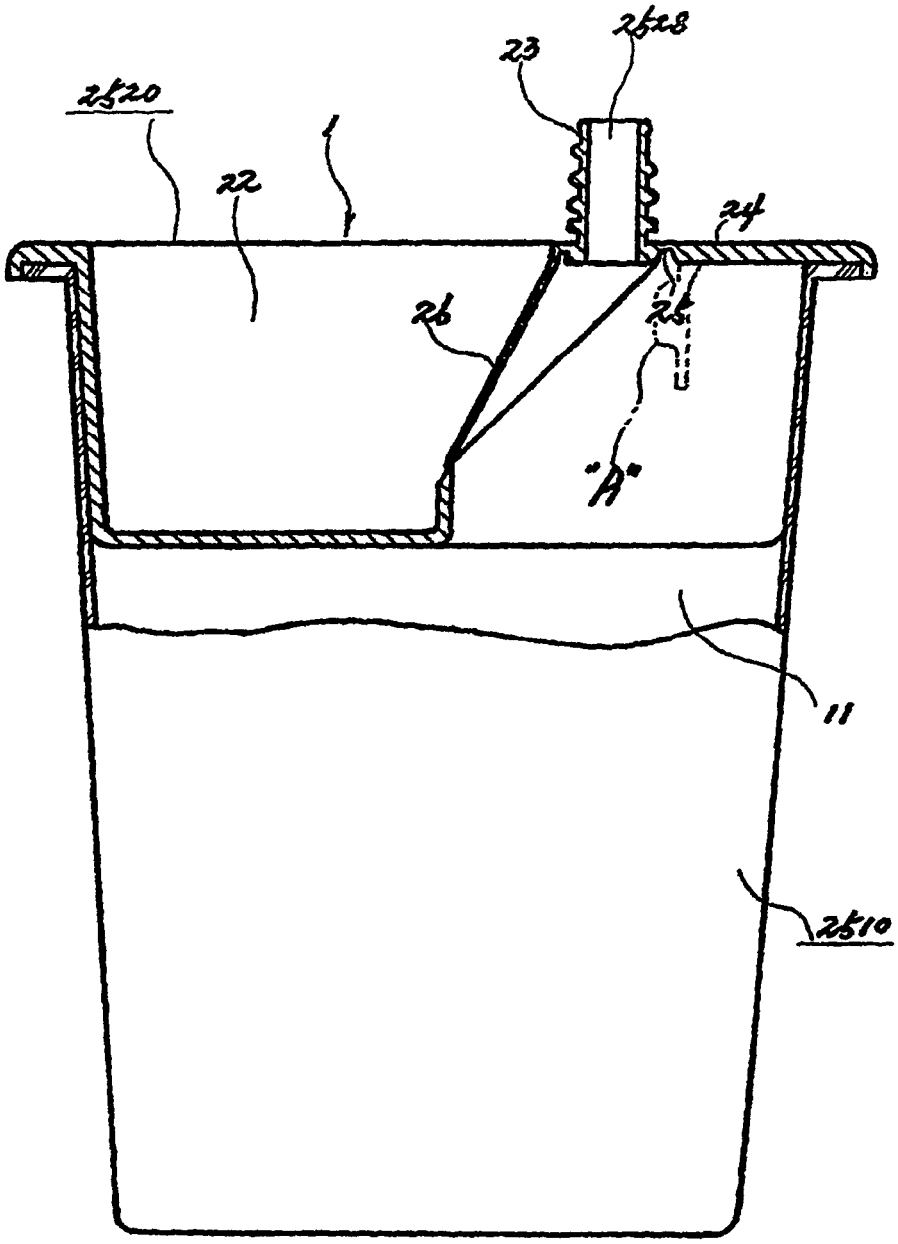

FIG. 23 shows a spouting portion 23 provided with a spouting hole 2528 through which the content can be spouted.

Figure 24:
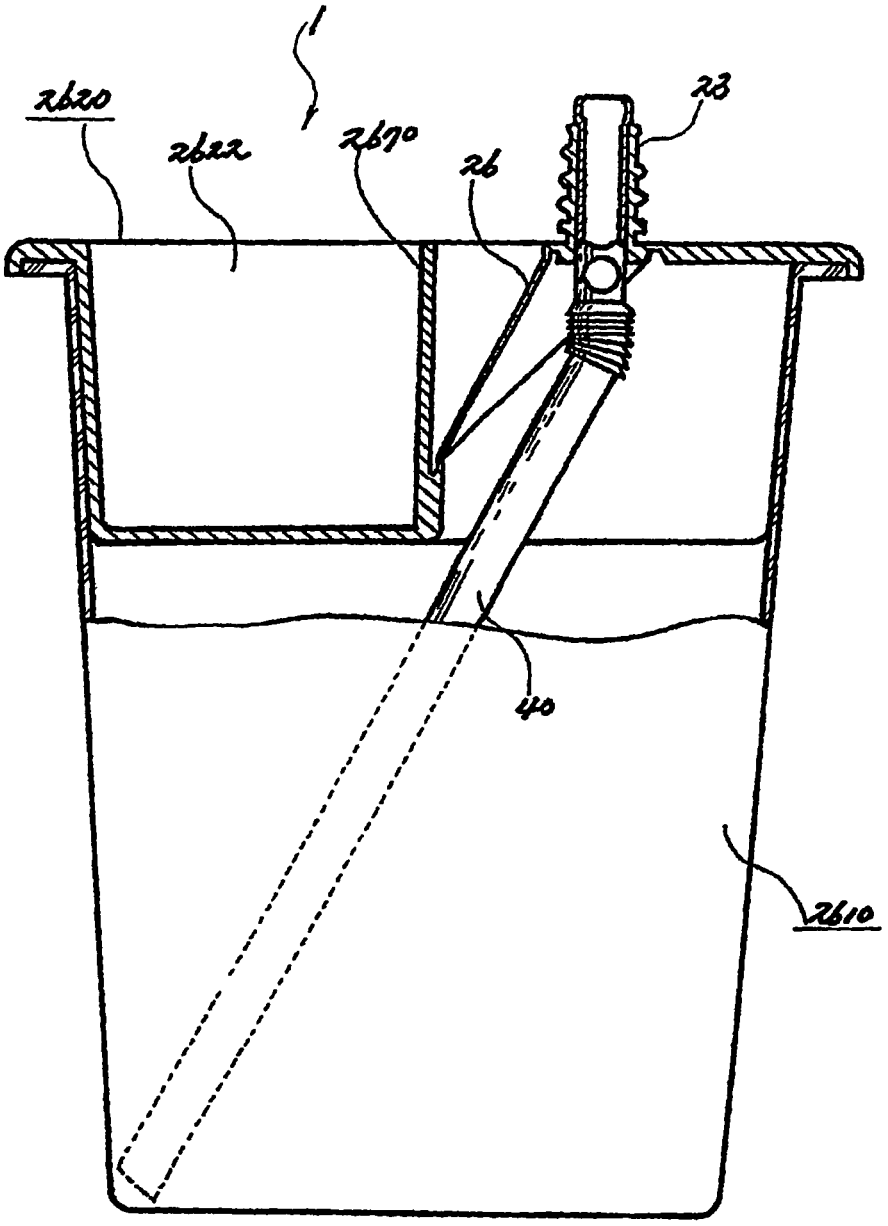

FIG. 24 shows a spouting portion 23 separated from a sub-receiving cavity 2622 by a separating wall 2670 for reason of sanitation.

Figure 25:
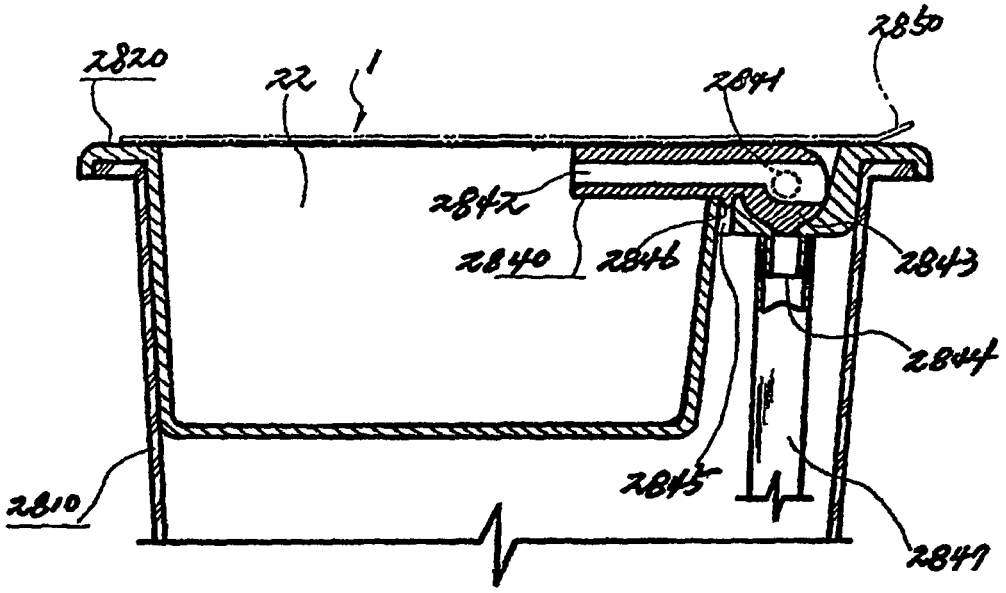

FIG. 25 shows a spouting member 2840 that is designed to rotate at a predetermined angle by a coupling projection 2841 at a side portion of a sub-receiving cavity 22. The spouting member 2840 is provided with a longitudinal spout hole 2842 and a fixing portion 2843 with the coupling projection 2841 is provided with a seal projection for sealing an upper hole of a straw assembling part 2844.

An air intake hole 2845 is formed near the straw assembling part 2844. The spouting member 2840 is provided with a seal projection 2846 closing the air intake hole 2845.

In use, when the spouting member 2840 is elected based on the coupling projection 2841, the upper hole of the straw assembly part 2844 and the air intake hole 2845 are opened.

In this state, when sucking the spout member 2840, since the spout hole 2842 communicates with the straw 2847, the content in the main body 2810 is discharged. At this point, external air is introduced into the main body 2810 through the air intake hole 2845.

Figure 26:
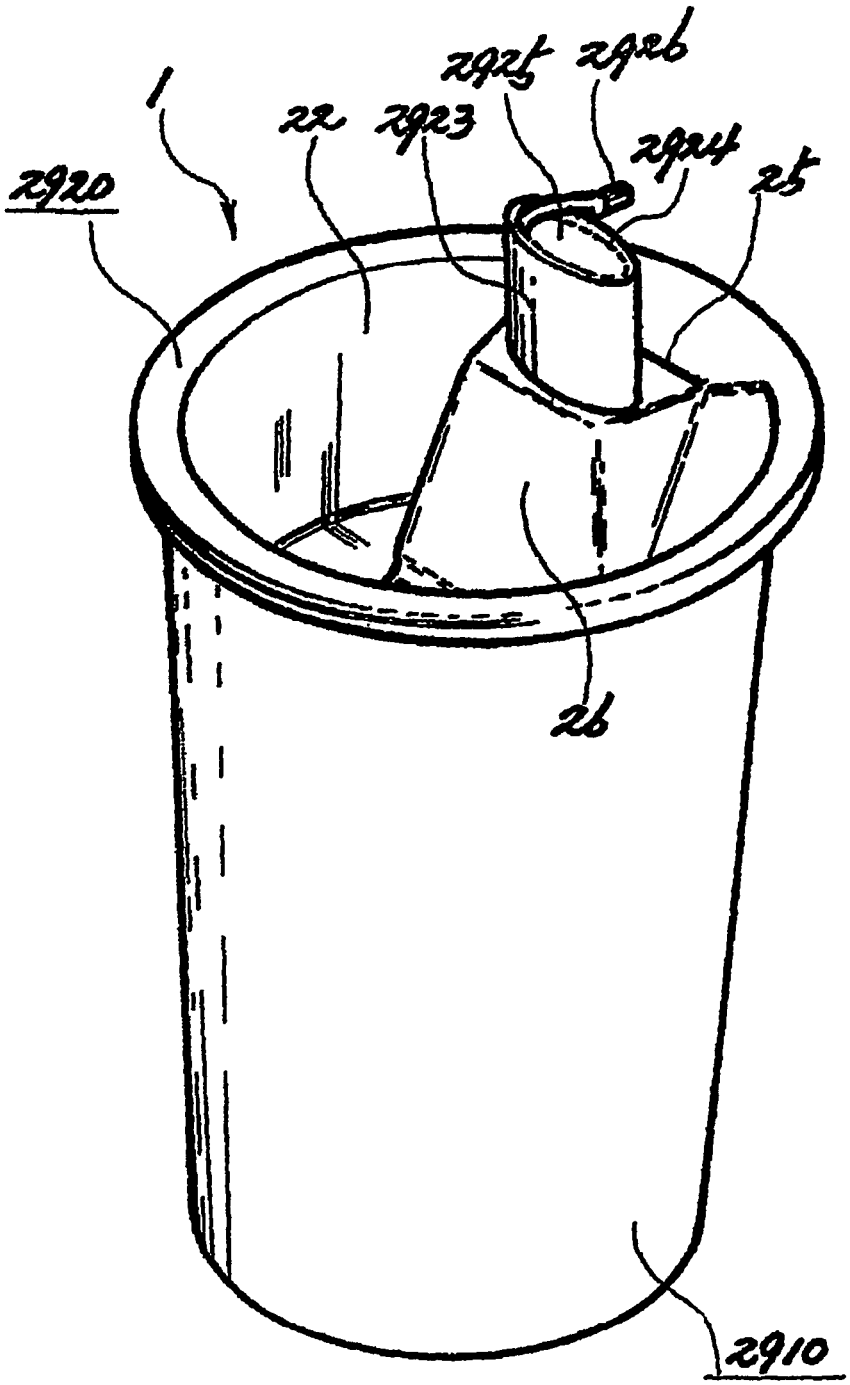
FIGS. 26 and 27 are perspective views of another embodiment of a spouting portion of the present invention.

FIG. 26 shows a spouting portion provided with a spout hole. An upper end of the spout hole is closed by a cutting film 2925 having a cutting line 2924. The cutting film 2925 is provided with a pulling handle 2926 to easily cut the cutting line 2924.

In use, when the pulling handle 2926 is pulled, the cutting film 2925 is removed while the cutting line 2924 is cut, thereby opening the spouting hole.

Figure 27:
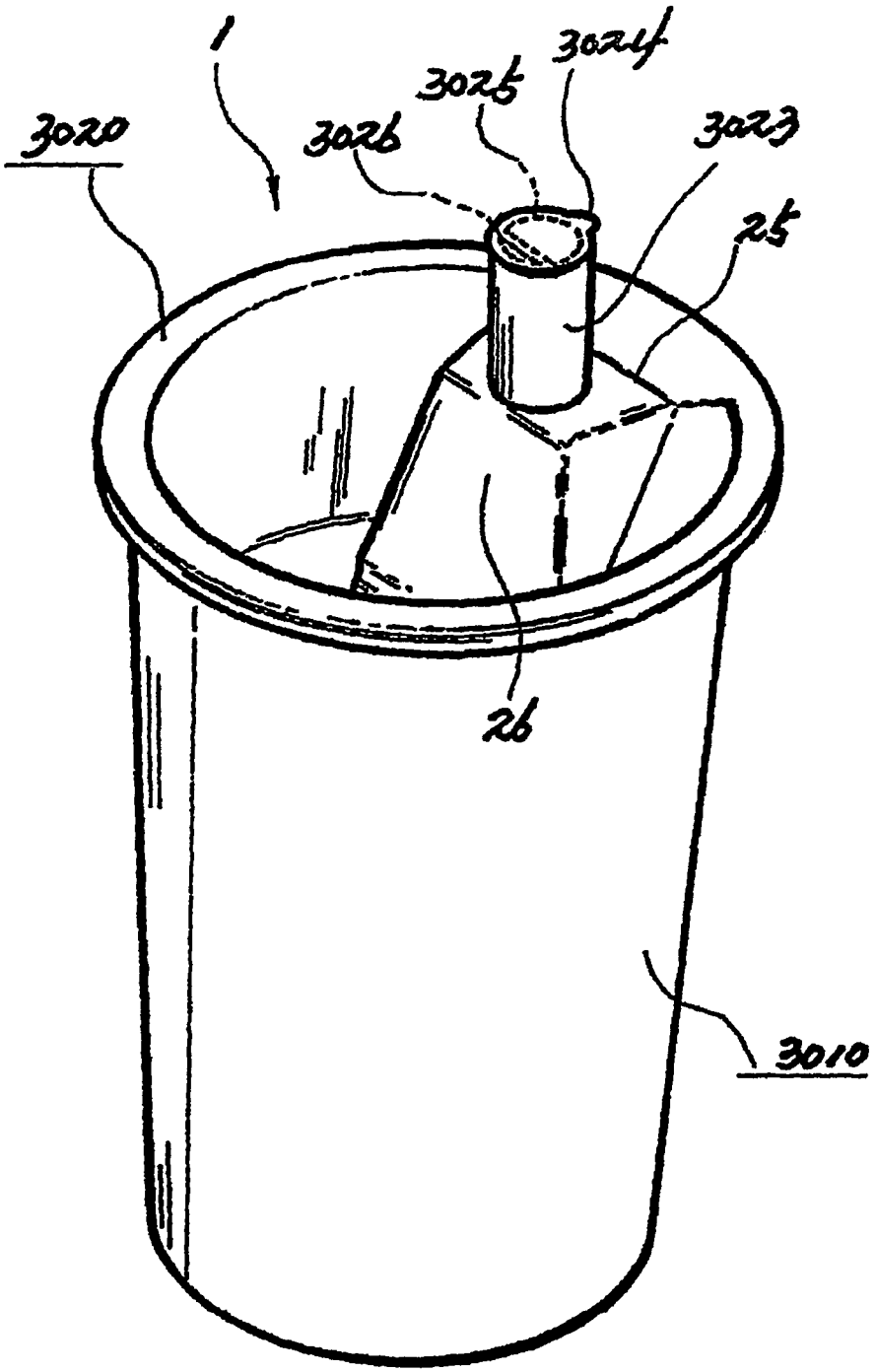

FIG. 27 shows a spouting portion provided with a spout hole and/or an air intake hole. A seal film 3024 closes an upper end of the spout hole.

Figure 28:
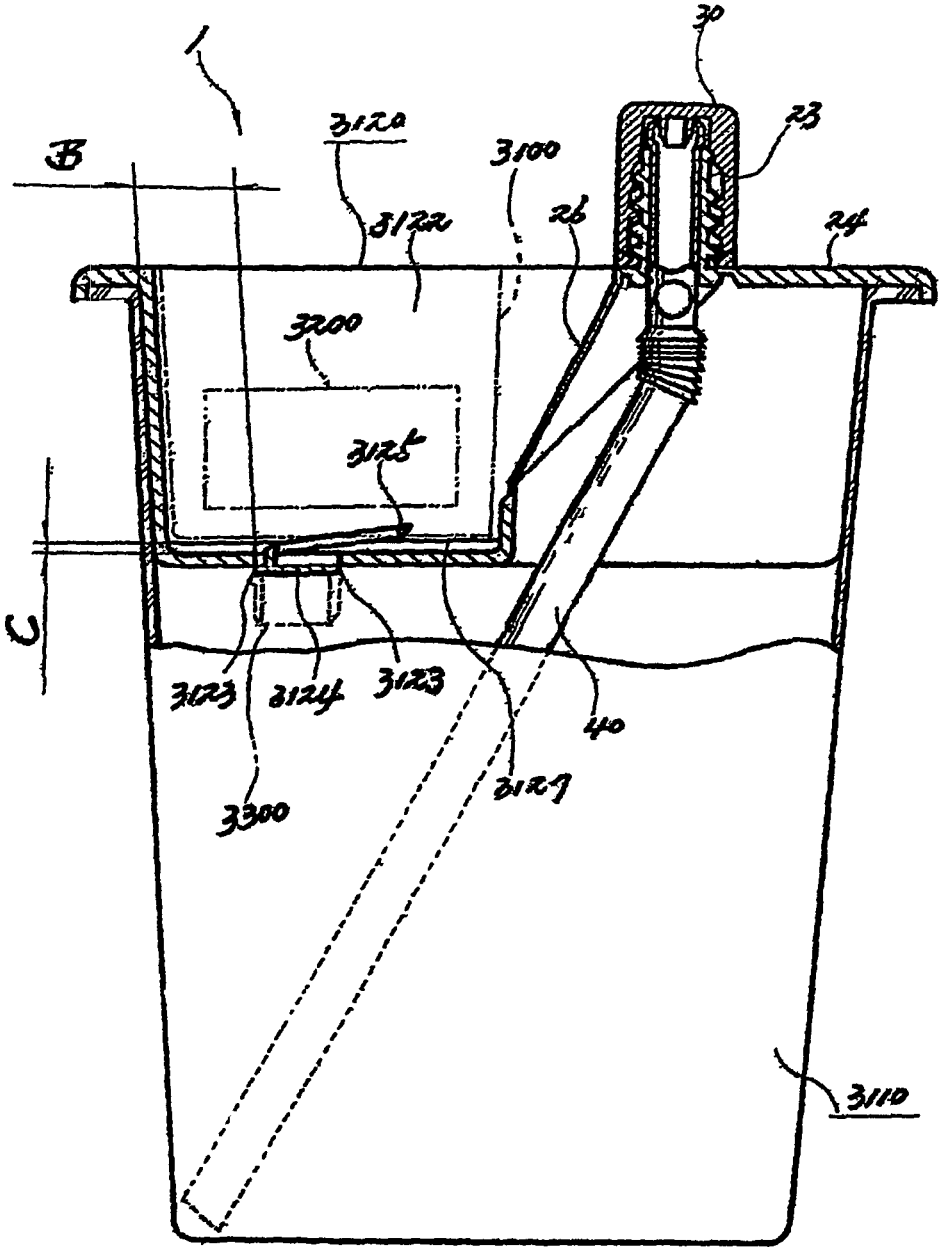
FIGS. 28 through 31 are sectional views of a sub-receiving cavity of the present invention.
Figure 29:
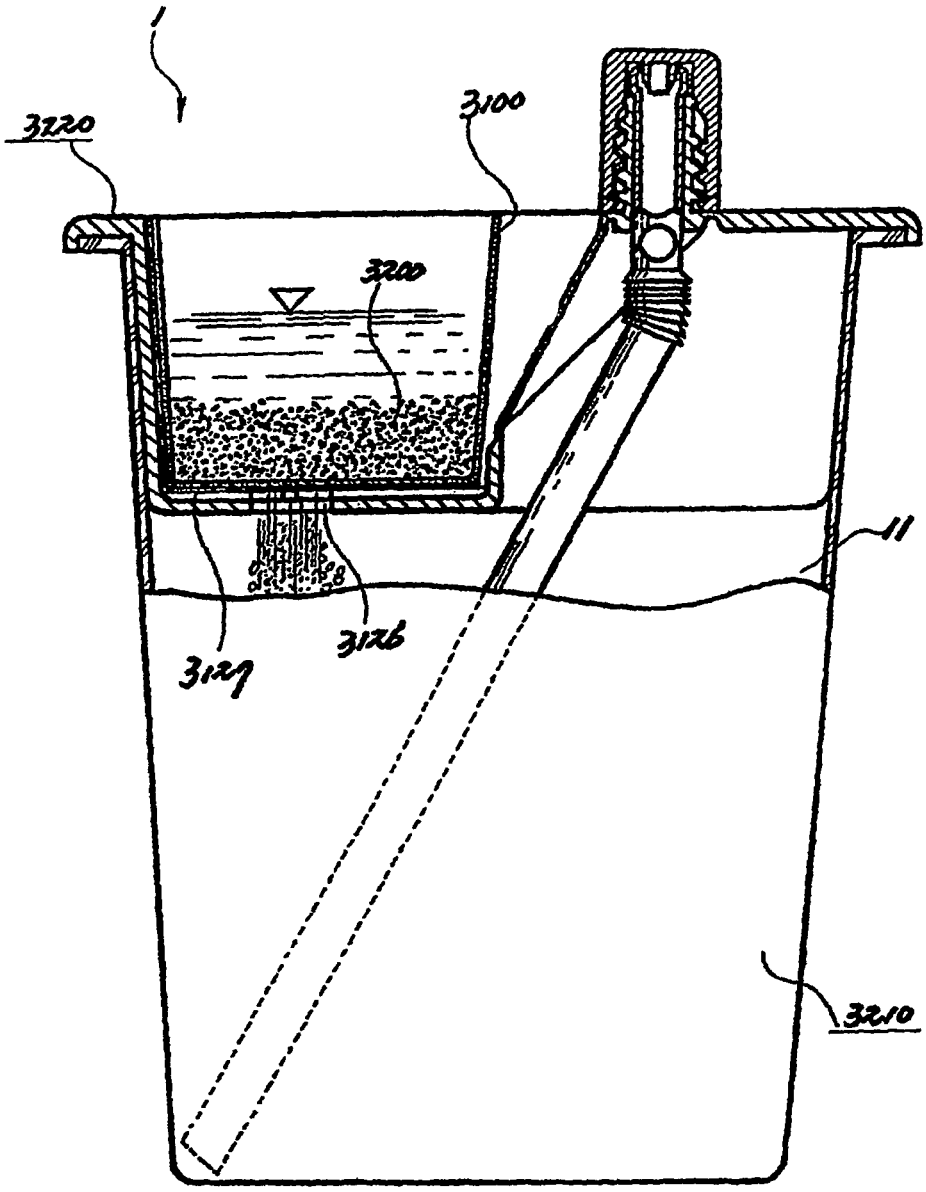

FIGS. 28 and 29 shows a sub-receiving cavity 3122 having other function rather than a function for containing snack.

The sub-receiving cavity 3122 is provided at it lower portion with a cutting film 3124 having a cutting line 3123. A pulling handle 3125 is formed on the cutting film 3124. A plurality of projections 3127 are formed on a bottom of the sub-receiving cavity 3122 toward a cutting hole 3126 formed by removing the cutting film 3124.

The projections 3127 functions to guide fluid to effectively flow regardless of materials contained in the sub-receiving cavity 3122.

By the projections 3127, a coffee dripping is possible in a state where the cutting film 3124 is removed by pulling the pulling handle 3125. That is, a paper filter 3100 containing ground coffee is disposed in the sub-receiving cavity 3122 and water is applied to the paper filter 3100. At this point, since a fluid flowing space is defined between the bottom of the sub-receiving cavity 3122 and the paper filter 3100 by the projections, the water containing coffee components can effectively flow into the main container through the cutting hole 3126.

The height C of the projections 3127 is properly adjusted according to a volume of the sub-receiving cavity 3122.

Figure 30:
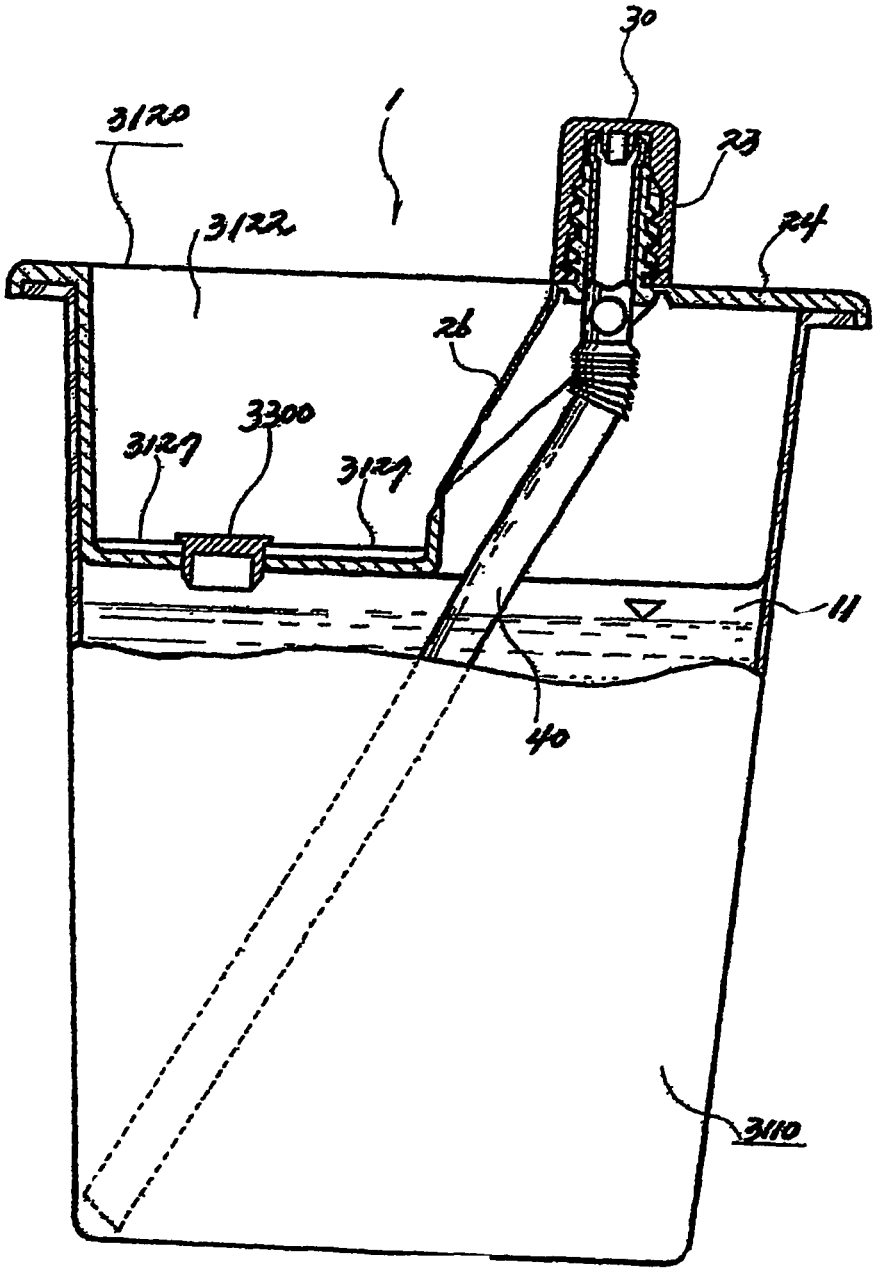

FIG. 30 shows that a cutting hole formed on a bottom of a sub-receiving cavity 3122 is closed by a closer 3300 to prevent the contents in the main body from flowing out through the cutting hole when the container is inclined.

Figure 31:
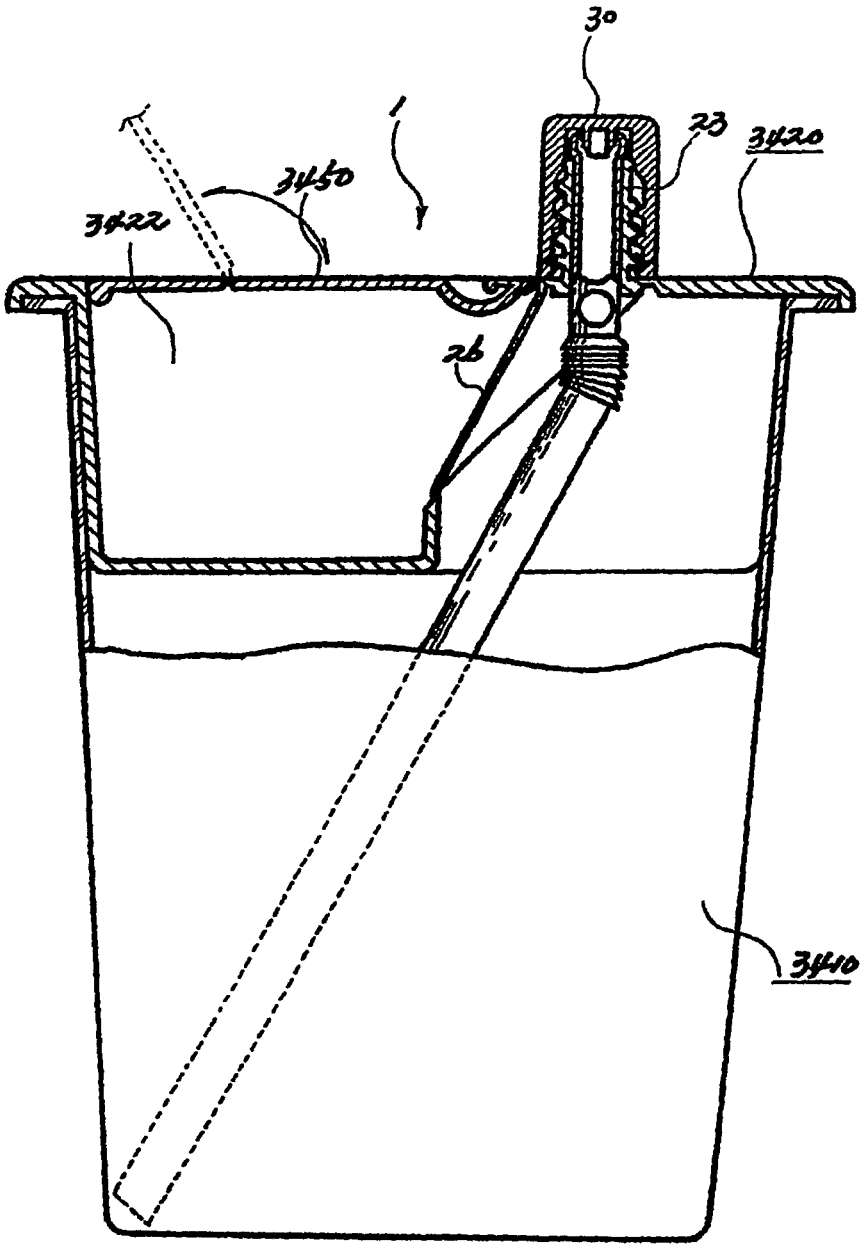

FIG. 31 shows that a sub-receiving cavity 3422 is sealed by a seal member 3450 that is capable of reseal the sub-receiving cavity 3422.

INDUSTRIAL APPLICABILITY

As described above, the present invention provides a container for food and beverage that has a main receiving cavity and a sub-receiving cavity that are separated from each other.

The present invention further provides a container for food and beverage, which is designed to allow a user to drink beverage through a spouting member or to dispense the beverage to other containers.

The invention claimed is:

1. A food/beverage container comprising:

a main body having a main receiving cavity configured to contain contents, wherein the main body has a height defined between a top edge and a bottom edge when the main body is located in an upright position; and a concaved sub-receiving cavity formed into the main receiving cavity and sized and configured to receive other foods, wherein a food is contained within the concaved sub-receiving cavity, a spouting portion for discharging the contents, wherein the spouting portion is formed beside the concaved sub-receiving cavity, wherein the main receiving cavity and the concaved sub-receiving cavity are separate cavities with respect to each other, wherein the concaved sub-receiving cavity is sealed by a removable seal member located at the top edge of the main body and the spouting portion is closed by a closer that is extendible outward with respect to the top edge of the main body, wherein the removable seal member and the closer are separated from each, wherein the spouting portion is capable of bending into the sub-receiving cavity, wherein the main body receives a sub-container body coupled on a top of the main body, and further wherein the sub-container body defines sub-receiving cavity and the spouting portion.

2. The food/beverage container of claim 1 wherein a spout member is installed in the spouting portion.

3. The food/beverage container of claim 1 wherein the spouting portion is provided with an air intake hole.

4. The food/beverage container of claim 1 wherein the spouting portion has a straw insertion hole or a spouting hole.

5. The food/beverage container of claim 1 wherein the spouting portion has a cutting film provided with a pulling handle with a cutting line.

6. The food/beverage container of claim 1 wherein the spouting portion includes a folding portion to be bent in a direction.

7. The food/beverage container of claim 1 wherein the main body is increased in a diameter as it goes downward.

8. The food/beverage container of claim 1 wherein a bottom of the main body is sealed by a seal member.

9. The food/beverage container of claim 1 wherein the seal member is designed to reseal.

10. The food/beverage container of claim 2 wherein the spouting portion includes an operating spouting member slidably inserted in the spouting portion.

11. The food/beverage container of claim 1 wherein the sub-container body is tightly coupled to the main body through an insert forming process, a supersonic wave bonding process, a press forming process, or a screw-coupling process.

12. The food/beverage container of claim 1 wherein the main body is a metal can, a paper pack, or a pouch.

13. The food/beverage container of claim 1 wherein the sub-container body is provided with a cutting film with a cutting line and a pulling handle coupled on the cutting film.

14. The food/beverage container of claim 1 wherein the sub-container body is provided with a cutting hole and a closer for closing the cutting hole.

15. The food/beverage container of claim 13 wherein a paper filter is received in the sub-receiving cavity of the sub-container body.

16. The food/beverage container of claim 1, wherein the closer of the spouting portion is a screw.

17. A food/beverage container comprising:

a main body having a main receiving cavity configured to contain contents;

a concaved sub-receiving cavity formed into the main receiving cavity and sized and configured to receive other foods, wherein a food is contained within the concaved sub-receiving cavity;

a spouting portion for discharging the contents, wherein the spouting portion is formed beside the concaved sub-receiving cavity; and a removable seal member connected to a top end of the main body when the main body is located in an upright position, wherein the removable seal member is adapted to seal at least the sub-receiving cavity, wherein the main receiving cavity and the concaved sub-receiving cavity are separate cavities with respect to each other, wherein the spouting portion comprises a folding portion that is movable into an upright position when the removable seal member is at least partially removed from the main body, and further wherein the folding portion of the spouting portion is positionable at a bent position located within the concaved sub-receiving cavity before the sub-receiving cavity is sealable by the removable seal member.

18. A food/beverage container comprising:

a main body having a main receiving cavity configured to contain contents;

a concaved sub-receiving cavity formed into the main receiving cavity and sized and configured to receive other foods, wherein a food is contained within the concaved sub-receiving cavity;

a spouting portion for discharging the contents, wherein the spouting portion is formed beside the concaved sub-receiving cavity; and a removable seal member connected to a top end of the main body when the main body is located in an upright position, wherein the removable seal member is adapted to seal at least the sub-receiving cavity, wherein the main receiving cavity and the concaved sub-receiving cavity are separated cavities with respect to each other, wherein the spouting portion is positionable at a bent position located within the concaved sub-receiving cavity before the sub-receiving cavity is sealable by the removable seal member, wherein the spouting portion is configured to move separately with respect to the removable seal member.

19. The food/beverage container of claim 1, further comprising:

a sub-container body, defining the concaved sub-receiving cavity, sealed to the main body.

* * * * *